US005090297A

United States Patent [19]

Paynter

[11] Patent Number: 5,090,297

[45] Date of Patent: Feb. 25, 1992

[54] ALL-ELASTOMER FLUID-PRESSURE-ACTUATABLE TWISTORS AND TWISTOR DRIVE ASSEMBLIES

[75] Inventor: Henry M. Paynter, Pittsford, Vt.

[73] Assignee: Nathaniel A. Hardin, Forsyth, Ga. ; a part interest

[21] Appl. No.: 521,232

[22] Filed: May 9, 1990

[51] Int. Cl.[5] ..... F01B 19/00

[52] U.S. Cl. ..... 92/48; 92/68; 92/71; 92/92

[58] Field of Search ..... 42/48, 66, 67, 68, 71, 42/90, 91, 92

[56] References Cited

U.S. PATENT DOCUMENTS

| | | | |
|---|---|---|---|
| 3,019,772 | 2/1962 | Humphrey | 92/68 X |
| 3,066,853 | 12/1962 | Landenberger | 92/90 X |
| 3,453,967 | 8/1969 | Spurlock et al. | 92/90 X |
| 3,490,733 | 1/1970 | Berthaud | 92/92 X |
| 3,613,455 | 10/1971 | Hightower et al. | 92/92 X |
| 3,638,536 | 2/1972 | Kleinwachter et al. | 92/92 |
| 3,645,173 | 2/1972 | Yarlott | 92/92 |
| 3,854,383 | 12/1974 | Paynter . | |
| 4,108,050 | 8/1979 | Paynter | 92/48 |
| 4,138,206 | 2/1979 | Zinerich et al. | 92/67 X |
| 4,370,917 | 2/1983 | Bunyard | 92/68 X |
| 4,721,030 | 1/1988 | Paynter | 92/92 |
| 4,733,603 | 3/1988 | Kukolj | 92/92 |
| 4,751,868 | 6/1988 | Paynter | 92/48 |
| 4,751,869 | 6/1988 | Paynter . | |
| 4,784,042 | 11/1988 | Paynter | 92/48 |
| 4,792,173 | 12/1988 | Wilson . | |
| 4,976,191 | 12/1990 | Suzumori et al. . | |
| 5,033,270 | 7/1991 | Hardt | 92/91 X |

FOREIGN PATENT DOCUMENTS

| | | | |
|---|---|---|---|
| 2701843 | 7/1978 | Fed. Rep. of Germany | 92/90 |
| 58-81205 | 5/1983 | Japan | 92/90 |

*Primary Examiner*—Edward K. Look
*Assistant Examiner*—John Ryznic
*Attorney, Agent, or Firm*—Parmelee, Bollinger & Bramblett

[57] ABSTRACT

All-elastomer fluid-pressure-actuatable twistors have an elongated tubular wall of resilient elastomeric material extending between first and second mounting ends spaced from each other along a twist axis extending longitudinally within the twistor. The tubular wall encircles its twist axis and surrounds an elongated interior chamber. Interior reinforcing webs of resilient elastomeric material are joined to the wall. These web-partitions extend longitudinally within the chamber, separating the chamber into longitudinally extending compartments. By applying torque or other preform means in a first sense to the first mounting end relative to the second mounting end, the tubular wall and interior webs become twisted in the same sense around the twist axis into a generally helically-twisted configuration. Pressurized fluid fed into the twistor causes the tubular wall and internal webs to untwist, so overcoming the applied torque, and thereby turning the first mounting end relative to the second mounting end in a second sense opposite to the first sense. Each twistor advantageously can be molded or formed as an all-elastomer unit. Independently pressurized pairs of twistors are pre-twisted in opposite senses to form opposed pairs. When geared to a common shaft in a suitable twistor drive assembly, the opposed pair will provide for shaft rotation in either direction, the shaft being turned in opposite directions by feeding fluid with opposite unbalanced pressures into the opposed pair. Multiple twistor drive assemblies are stackable in an array so as to sum together their torque outputs.

65 Claims, 14 Drawing Sheets

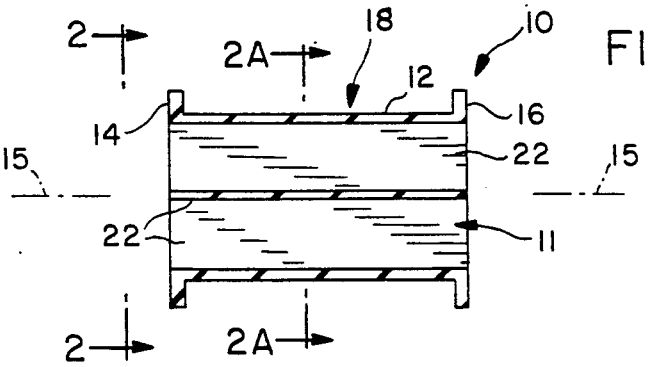
FIG. 1
FIG. 2A
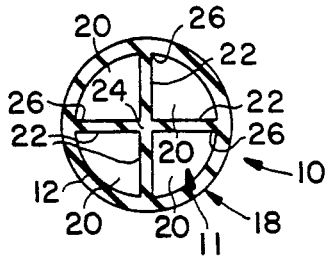
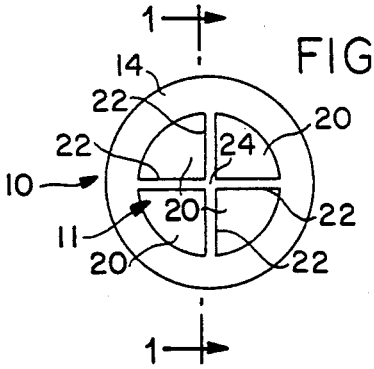
FIG. 2
FIG. 3
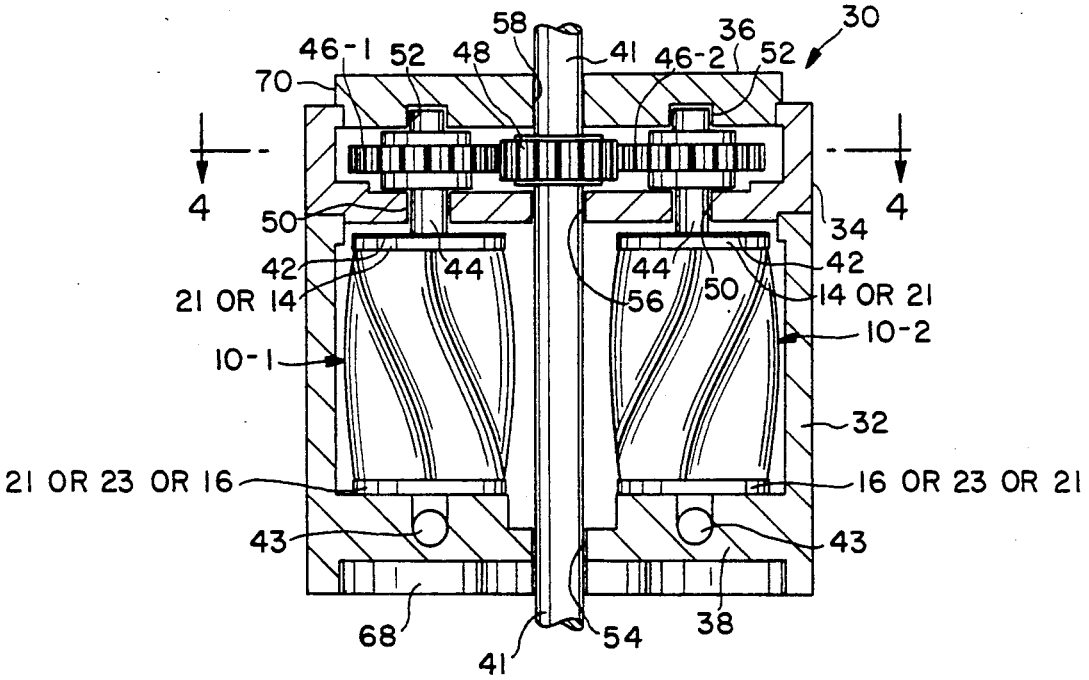

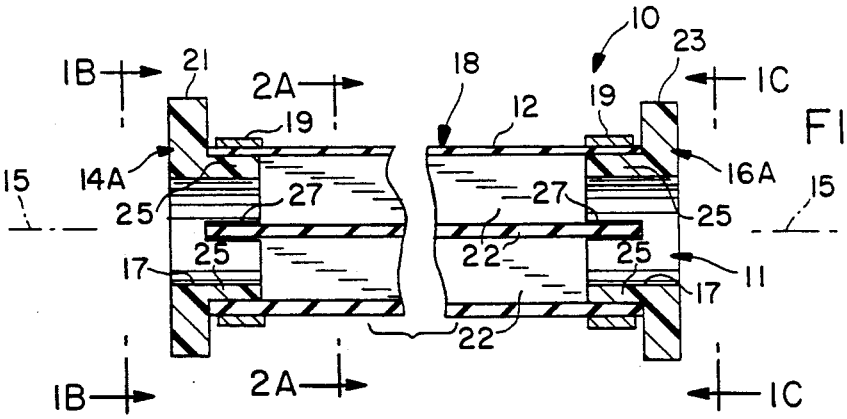
FIG. 1A
FIG. 1B
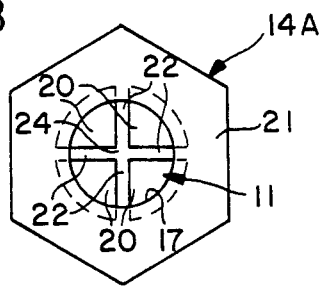
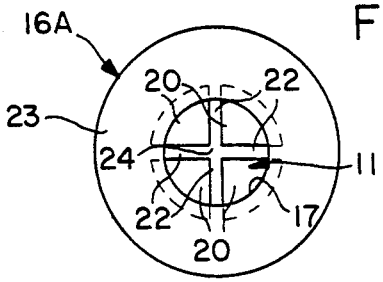
FIG. 1C
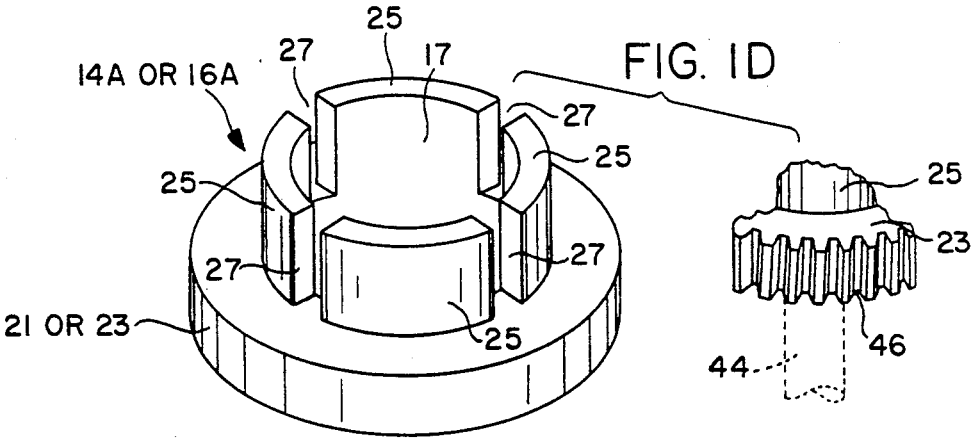
FIG. 1D
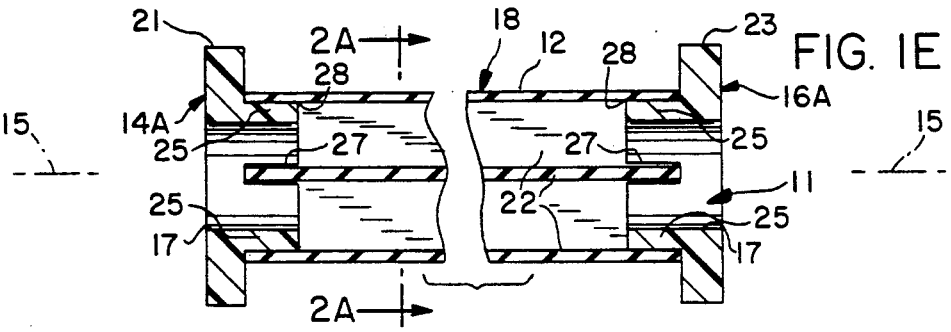
FIG. 1E FIG.8
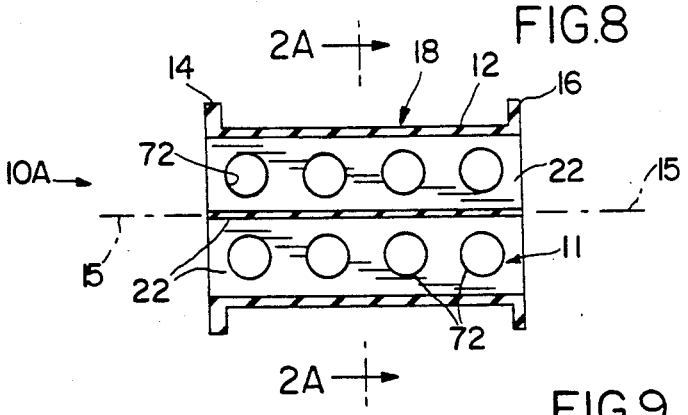
FIG.9
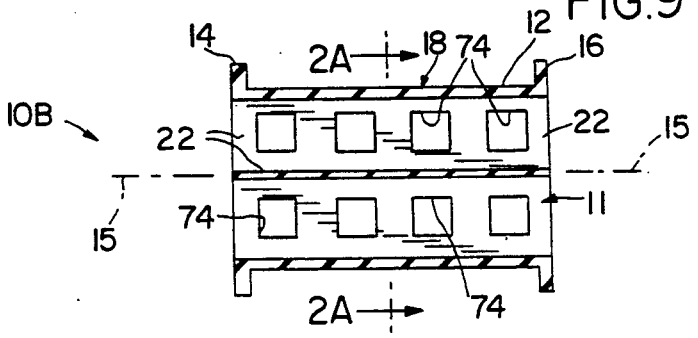
FIG.10
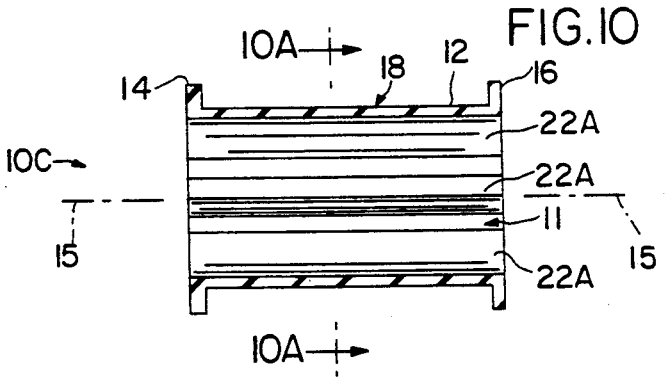
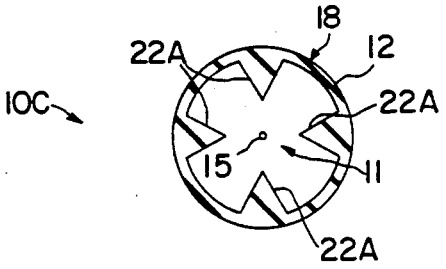
FIG.10A
FIG.10B
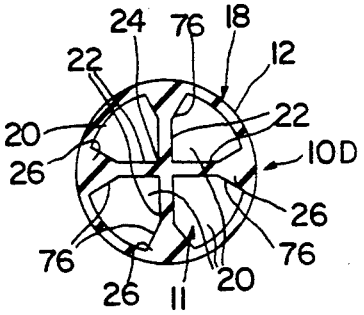
FIG.11B
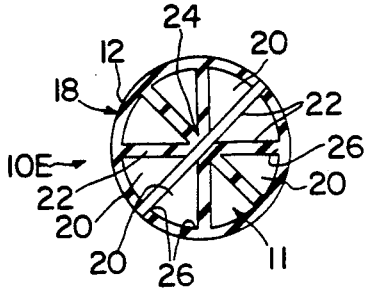

FIG.14
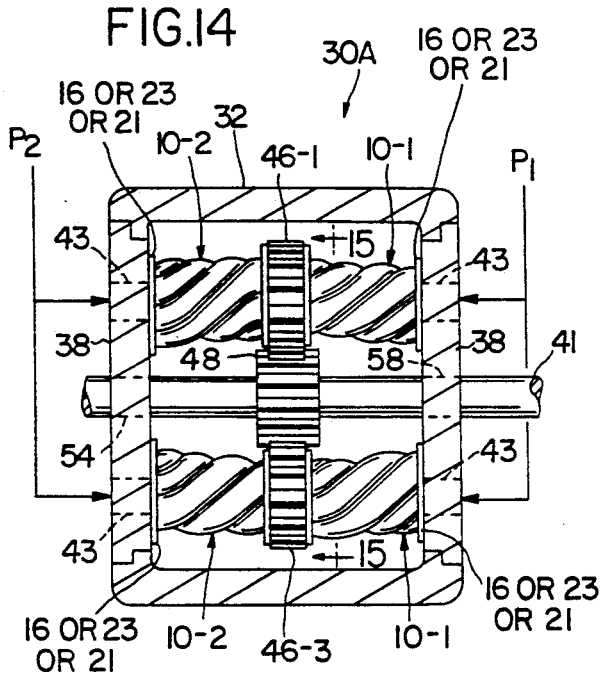
FIG.15
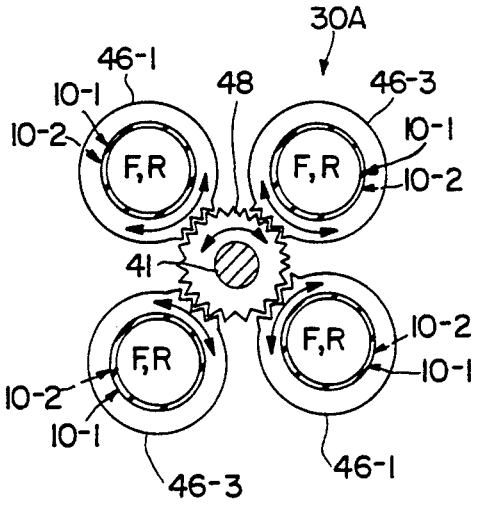
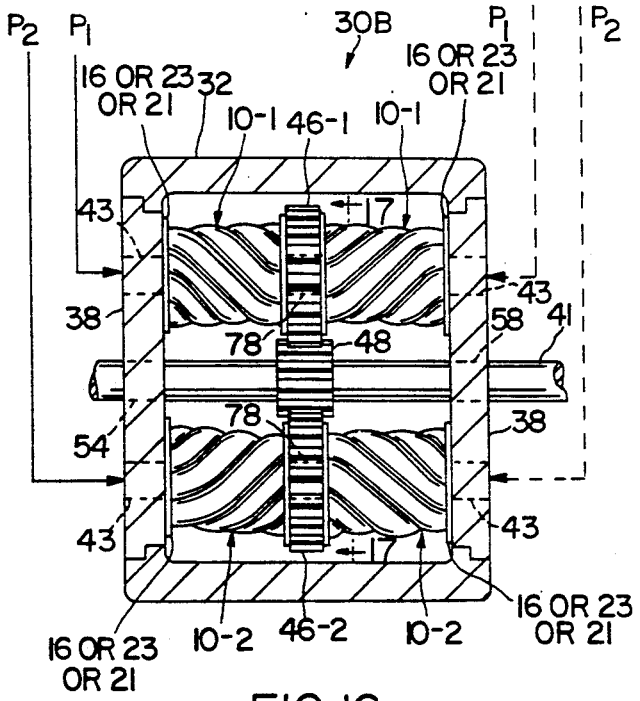
FIG.16
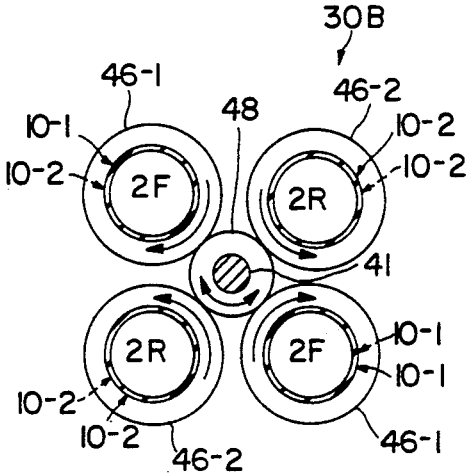
FIG.17

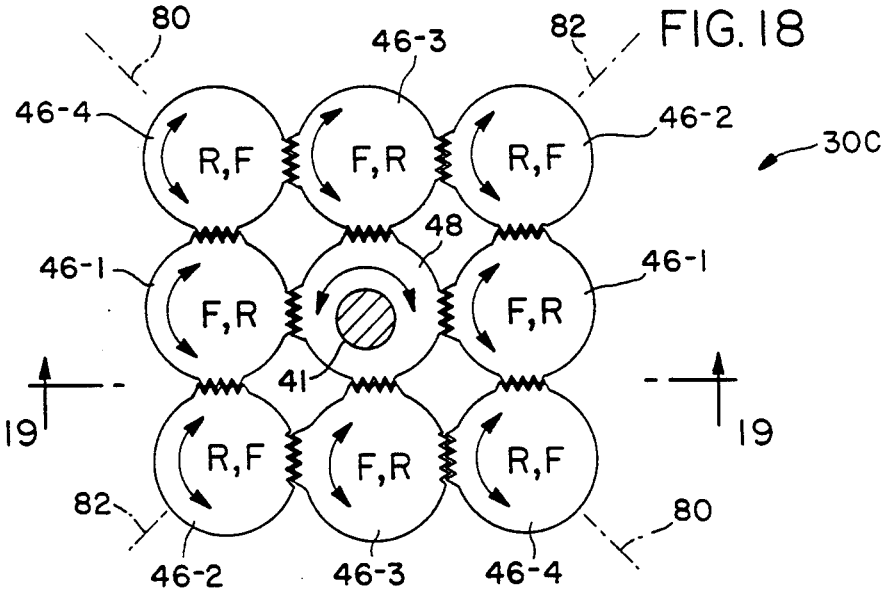
FIG. 18
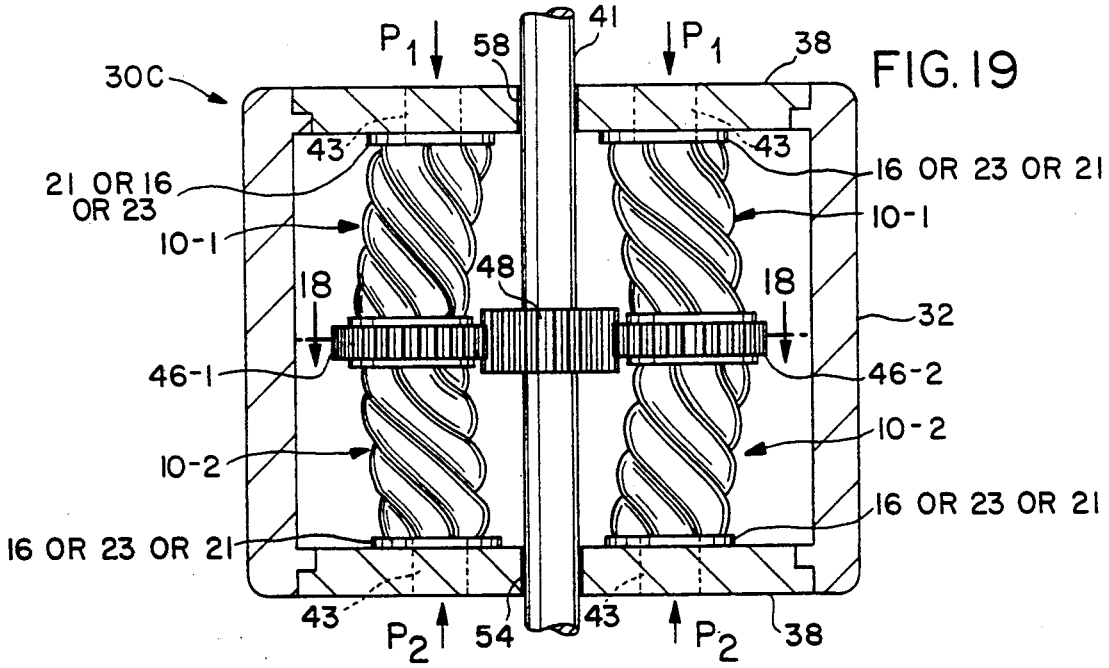
FIG. 19
FIG. 23
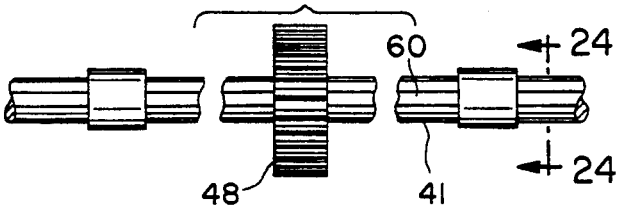
FIG. 24
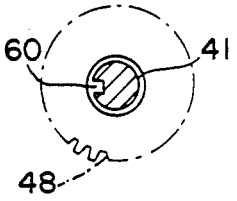

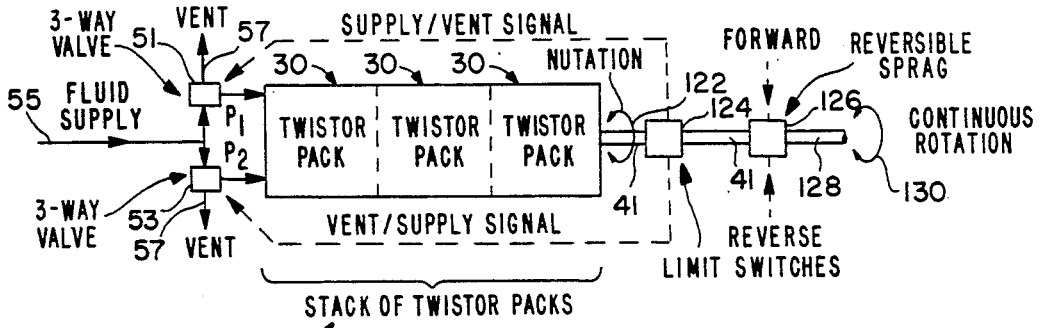
FIG. 25
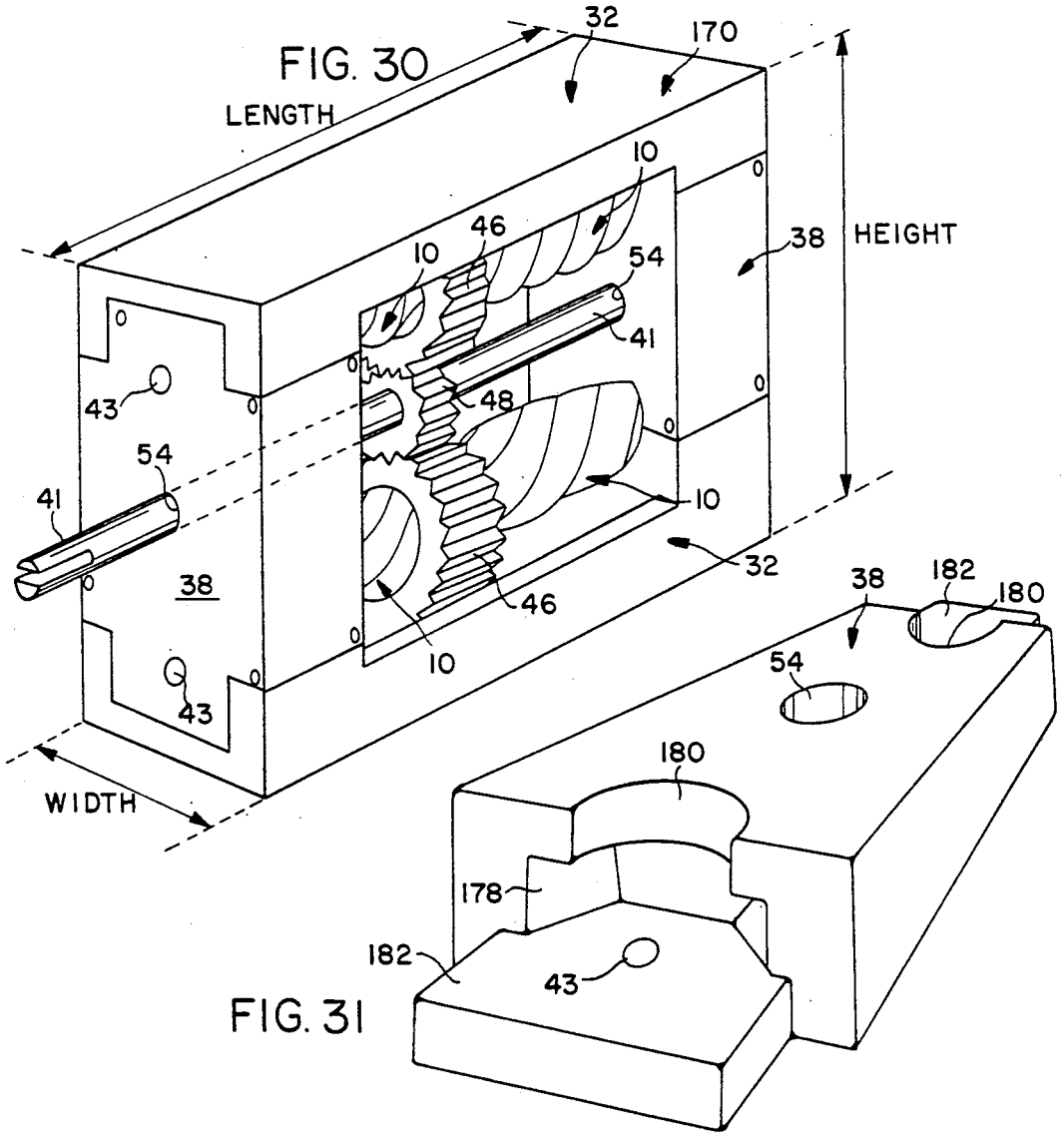
FIG. 30
FIG. 31

RADIAL BOW FORCE:
(NOT TO SCALE)

FORCE DIAGRAM:

EQUILIBRIUM BALANCE:

(196) $F = [2 \sin \theta] \times T$ (198) $T = KP_0 + T_0$

200 $\therefore$ $\boxed{F = [2K \sin \theta_0] P_0 + F_0}$

ALSO:

TWISTOR ACTIVE STIFFNESS TORQUE LEVEL:

TORQUE LEVEL $M_0 = CP_0$ ← 202

204 $\therefore$ $\boxed{F = F_0 + kM_0}$

ALL-ELASTOMER FLUID-PRESSURE-ACTUATABLE TWISTORS AND TWISTOR DRIVE ASSEMBLIES

FIELD OF THE INVENTION

The present invention is in the field of fluid-pressure actuators and more particularly relates to all-elastomer fluid-pressure-actuatable twistors each advantageously moldable or formable from resilient elastomeric material and especially adapted to be used in opposed pairs pre-twisted in opposite senses and geared to a common output shaft to produce rotation of the shaft in opposite directions in a twistor drive assembly. Feeding fluid under various and different controlled pressures into the opposed pairs of twistors causes the common output shaft to be rotated smoothly into various predeterminable angular positions in an open-loop control system. By cyclically reversing the shaft rotation, a continuous fluid motor results upon attaching a sprag to the shaft.

BACKGROUND

There are two types of fluid-pressure-driven actuators which employ elastomeric (rubbery) shells (often called "bladders"), namely: (a) twistor actuators (herein often called "twistors") and (b) tension actuators (often called "linear actuators").

All such prior actuators have involved a network of relatively inextensible or non-stretchable flexible reinforcing strands in order to constrain the rubbery bladder so as to cause the repeatedly inflated and deflated bladder to perform in a predictable manner and to prevent unpredictable localized stretching and bulging of the bladder wall. In some prior actuators, this network of inextensible strands surrounded the bladder without being bonded to the bladder. Paynter U.S. Pat. No. 4,721,030 and Kukolj U.S. Pat. No. 4,733,603 (FIG. 1) disclosed a surrounding network of inextensible strands neither bonded nor attached to the exterior surface of the bladder. In other prior actuators, this network of inextensible strands was bonded or attached to the outside surface of the bladder. Yarlott U.S. Pat. No. 3,645,173 and Paynter U.S. Pat. Nos. 4,108,050, 4,751,868 and 4,751,869 disclosed relatively inextensible strands bonded to the exterior surface of the bladder. Kukolj in FIG. 16 showed a network of non-stretchable flexible elements, such as braided wire, embedded within the elastomeric material from which the wall of the bladder was made.

It is noted that in Paynter '030 the multiple inextensible strands, which formed a network surrounding the bladder of the tension actuator shown in that patent, had the configuration of a hyperboloid of revolution when the actuator was in its deflated and elongated condition. Such configuration of the network of inextensible strands prevented any twist motion of that tension actuator.

Such prior actuators having the above-described composite structures of an elastomeric bladder with a network of relatively inextensible strands were complicated and expensive to fabricate. Considerable hand labor often was required in their fabrication. Also, the incompatibility of the non-stretchable network in association with the stretchable bladder created undesirable stress-concentration points in the bladder wall as the bladder was repeatedly inflated and deflated during multiple cycles of operation. Such stress-concentration points often caused premature tearing or rupture of the bladder wall, thereby on average leading to relatively short operating lives.

In those cases where the network of non-stretchable strands surrounded the bladder without being bonded thereto, a localized frictional, abrasive rubbing action often occurred between the non-attached strands and the bladder wall during inflation and deflation. Such abrasive rubbing action often induced premature failure, thereby causing relatively short average operating lives. It is interesting to note that Kukolj in FIGS. 11 and 13 showed a perforated, friction-reducing layer which was interposed, as shown in FIG. 9, between the inner bladder shown in FIG. 12 and an outer network of inextensible strands. In order further to reduce the deleterious effects of abrasive friction, Kukolj taught that a lubricant is applied between the friction-reducing layer and the inner bladder. It is submitted that his willingness to employ a complex, expensive, friction-reducing layer plus lubricant in such a composite structure serves to emphasize the novelty and non-obviousness of the present all-elastomer twistors.

In summary, such prior composite-structure, fluid-driven actuators were difficult to fabricate, complex and expensive and provided relatively short average operating lives.

SUMMARY

All-elastomer fluid-pressure-actuatable twistors include a tubular wall and interior webs of various configurations which reinforce the tubular wall so as to prevent ballooning and which reduce the "dead volume" of the chamber surrounded by the tubular wall so as to reduce fluid demand. The tubular wall includes first and second mounting means at its respective ends. In some embodiments these interior webs are imperforate partitions joined together along a twist axis of the twistor and joined to the tubular wall, thereby separating the chamber into multiple compartments extending longitudinally along the twistor. These interior compartments are accessible for inflation by pressurized fluid fed into the compartments through at least on end of the twistor.

By applying torque to the first mounting means in one sense around the twist axis relative to the second mounting means, the twistor becomes twisted around its twist axis into a generally helically twisted configuration. Alternatively, one may initially mold or otherwise preform the tube into this pretwisted geometry. By feeding fluid under pressure into the compartments, the twistor is caused to untwist, thereby overcoming the applied torque for turning the first mounting means around the twist axis in the other sense to provide useful, smooth turning motion.

The twistors as described are each advantageously moldable or formable from tough, resilient, elastomeric material such as polyurethane as a monolithic all-elastomer unit. The first and second mounting means are shown in some embodiments as comprising first and second rims encircling the twist axis at opposite ends of the twistor. These rims are also integrally moldable with the respective ends of the tubular wall.

Splined mounting end lugs with encircling O-ring seals on the ends of twistors can be slid into support sockets for quick and convenient installation into twistor drive assemblies.

In one embodiment pairs of these twistors are pretwisted in opposite senses and are geared to a common output shaft for acting as opposed pairs in a twistor drive assembly capable of turning the shaft in either direction. The common output shaft is turned into predetermined angular positions by controlling the respective pressure levels of fluid being supplied into the opposed pairs of twistors in an advantageous open-loop control system which uniquely offers simple direct manipulation of output shaft position and effective stiffness.

These twistor drive assemblies ar especially adapted for stacking in an end-to-end relationship in an axially extended stacked array having a common output shaft extending through the entire stacked array. Thus, the turning moments of these stacked twistor drive subassemblies in the array are added together in jointly turning the common output shaft in either direction.

The twistor drive assemblies are designed to accommodate various gear ratios between the pairs of opposed twistors and their common output shaft, thereby providing great flexibility for use in various applications, some of which may require a greater range of angular travel of the common output shaft and others of which may require greater turning moment with less angular travel of the common output shaft. Moreover, multiple twistor drive assemblies can be stacked together in an end-to-end array in applications where greater output turning moments are desired.

A continuous, reversible, nutating motor is provided upon attaching a sprag drive to the output shaft.

By virtue of their all-elastomer construction, the various configurations of these twistors as disclosed are less expensive to fabricate than prior twistor actuators and they offer promise of longer operating lives than prior pressurized-fluid-driven actuators having composite structures incorporating relatively inextensible or non-stretchable flexible reinforcing strands which caused deleterious stress-concentrations and/or abrasions of the strands and in the bladder wall.

In certain embodiments of the invention the twistor body (which comprises a tubular wall having internal elements integral with the tubular wall, for example, such as webs, ribs, flanges, fillets or partitions) is formed by extruding. Then, the end mounting means can comprise two separate end fittings, which are attached to the opposite ends of the twistor body with an air-tight attachment. The twistor body can be relatively elongated for providing a plurality of twistors in series in end-to-end relationship, thereby comprising a "twistor string". Because each twistor in the twistor string can readily supply 60 degrees of rotation, the "N" twistors in a twistor string can readily supply $N \times 60$ degrees of rotation, which can then be geared down, if desired, to increase torque output. Such a gearing down can be obtained by bevel gearing or by a worm-gear drive or by spur gearing. The twistor string can be arranged to extend longitudinally along a strut serving like a bone in an arm or leg of a robot. For example, such a strut can be a hollow tube with the twistor string extending longitudinally within this tube. Then, a worm-gear drive or a bevel-gear drive is used in association with a pivoted joint or articulation for moving a second strut, which is swingably joined to the strut containing the twistor string.

Various configurations of end fittings are shown and various attachments between these end fittings and an extruded twistor body are described. The end fitting can be arranged to mount within a socket in a keyed engaged relationship with the socket for preventing rotation of the end fitting relative to its socket. Such a keyed engaged relationship is provided by a hexagonal or splined shape or other non-circular shape of the mounting portion of the end fitting. Also, the end fitting can have a tailored shape for acting as an output device for imparting motion or torque, for example, an end fitting is shown with a rim having spur gear teeth.

BRIEF DESCRIPTION OF THE DRAWINGS

The invention, together with further aspects, objects, features and advantages thereof will be more clearly understood from a consideration of the following description in conjunction with the accompanying drawings which are arranged for clarity of illustration and not necessarily drawn to scale, and in which like reference numerals are used to refer to corresponding elements, components or assemblies throughout the various views.

FIG. 1 is a longitudinal sectional view of an all-elastomer twistor embodying the present invention. This sectional view in FIG. 1 is taken along the line 1—1 in FIG. 2, which is slightly offset to the left of the twistor axis for more clearly showing the reinforcing web-partition structure. In FIG. 1, the two end fittings are shown as flanges on opposite ends of the tubular elastomer twistor body and being integral with the twistor body.

FIG. 1A is a longitudinal sectional view similar to FIG. 1, except that FIG. 1A shows that the twistor body can be an elongated extruded elastomer tube having internal webs integral with the tubular wall. These internal webs are internally joined along the axis of the twistor body forming partitions dividing the interior of the twistor into multiple longitudinally-extending sector-shaped compartments. The two end fittings are separate pieces which are clamped air-tight to opposite ends of the twistor body.

FIG. 1B is an end elevation of the twistor of FIG. 1A, as seen from the position 1B—1B, showing a hexagonal shape of a flange on an end fitting.

FIG. 1C is an end elevation of the other end of the twistor of FIG. 1A, as seen from the position 1C—1C, showing a circular shape of a flange on an end fitting.

FIG. 1D is an enlarged perspective view of an end fitting, and FIG. 1D includes a fragmentary perspective view for showing a flange on an end fitting provided with spur gear teeth, and also a stub shaft as shown in dashed outline may project axially from this spur gear.

FIG. 1E is a longitudinal sectional view similar to FIG. 1A showing that the end fittings are bonded to the twistor body, for example, by adhesive.

FIG. 2 is an end elevational view of the twistor of FIG. 1 as seen from the end position 2—2 in FIG. 1.

FIG. 2A is a cross-sectional view of the twistor of FIGS. 1 and 2 and of the twistors of FIGS. 1A and 1E and of FIGS. 8 and 9. This cross-sectional view in FIG. 2A is taken along the plane 2A—2A in FIG. 1 and in FIG. 1A and in FIG. 1E and in FIG. 8 and in FIG. 9.

FIG. 3 is an elevational sectional view of a twistor drive assembly (herein also called a "twistor pack") showing a pair of oppositely pre-twisted twistors operating as an opposed pair for turning a common output shaft in either direction. FIG. 3 is a view taken along the plane 3—3 in FIG. 4.

In FIG. 3A, the common output shaft seen in FIG. 3 has been removed; and in lieu thereof, an output shaft is directly connected to one of the twistors. Hexagonal mounting portions of end fittings fit into hexagonal sockets in the housing for providing a keyed engagement in each socket mount for anchoring the end fittings against rotation.

FIG. 4 also indicates the fluid passages for feeding these four twistors operating as two opposed pairs.

FIG. 3A shows an open-loop control system similar to that shown in FIG. 5.

FIGS. 8 and 9 are longitudinal sectional views similar to FIGS. 1, 1A and 1E showing other embodiments of twistors in which the reinforcing webs have circular openings or square openings, respectively.

FIG. 10 is a longitudinal sectional view of a twistor body similar to FIGS. 1, 1A and 1E in which the reinforcing webs have generally triangular cross-sectional shapes as seen in FIG. 10A, which is a cross section taken along the plane 10A—10A in FIG. 10. The twistor body shape of FIG. 10A can be formed, for example, by extrusion.

FIG. 10B is a cross-sectional view of a twistor body formed, for example, by extrusion in which the partitions include fillets contiguous with the tubular wall.

FIG. 14 is a sectional view through another embodiment of a twistor drive assembly (twistor pack) in which a pair of twistors are attached to each drive gear on opposite sides in a monolithic twistor-pair drive arrangement. Each pair of twistors is helically twisted in the same sense, thus providing both forward (F) and reverse (R) drive torque. This drive arrangement utilizes the unique flexural properties of monolithic twistor pairs in an improvement upon the drive arrangement taught in my U.S. Pat. No. 4,751,868. In such and similar arrangements arbitrary gear-ratios are readily obtained (as illustrated in FIGS. 4, 7 and 7A). Advantageously, only two shaft bushings or bearings are required for rotatably mounting the common output shaft, regardless of the number of monolithic twistor-pairs employed.

FIG. 15 is a partial sectional view taken along the plane 15—15 in FIG. 14 showing the gearing engagement and fluid-powered torque action.

FIG. 16 is a sectional view through another twistor pack in which each drive gear straddles a pair of twistors in a monolithic dual twistor-pair drive arrangement. Each pair of twistors is helically twisted in opposite senses. Thus, the two twistors attached to a gear are operating in parallel aiding relationship, thereby providing twice the forward drive torque (2F) or twice the reverse drive torque (2R) from each such monolithic dual twistor-pair.

FIG. 17 is a partial sectional view taken along the plane 17—17 in FIG. 16 showing the gearing arrangement and fluid-powered torque action.

FIG. 18 is a partial sectional view taken along the plane 18—18 in FIG. 19. FIG. 18 depicts another gearing arrangement yielding a compact powerful twistor pack in which four forward/reverse (F, R) twistor-pairs are engaged directly with the centrally-located shaft gear, while four more reverse/forward (R, F) twistor-pairs engage only with the adjacent gears of the forward/reverse twistors. Thus, eight twistor-pairs are included in this twistor pack.

FIG. 19 is an elevational sectional view taken along the plane 19—19 in FIG. 18. A unique feature of my invention is that the twistor-pairs are intentionally mounted in a bow-legged configuration, as is clearly illustrated in FIG. 19, for holding their output drive gears firmly in engagement with the driven gear on the common output shaft or firmly in engagement with the gear of an adjacent twistor-pair. A similar bow-legged twistor-pair mounting arrangement is shown in FIGS. 14 and 16, but FIG. 19 shows this bow-legged arrangement more clearly than in FIGS. 14 and 16.

FIG. 22 (sheet 11) shows a pair of twistors on opposite sides of their central drive gear. Each twistor has a keyed mounting end (hexagonal-shaped end) adapted to be inserted into a conforming socket. The central gear is generally ring-shaped and has a hexagonal axial opening for providing clearance to fit over a hexagonal end of the twistor-pair. This central gear is captured on a twin-lug central mount and is held in place by a washer-shaped retainer having a hexagonal axial opening for providing clearance to fit over the other hexagonal end of the twistor-pair. U-shaped washers and other capturing devices are also possible.

FIG. 23 (Sheet 9) shows bearing sleeves and a gear mounted on a keyed shaft for ease of assembly.

FIG. 24 (Sheet 9) is a cross sectional view taken along the plane 24—24 in FIG. 23.

FIG. 25 (Sheet 12) illustrates a multiple twistor pack drive assembly employed with a reversible sprag (one-way clutch) to achieve a compact and powerful fluid motor providing continuous rotation of an output shaft.

FIG. 28 shows a joint which is fluid-power-driven in either direction, i.e. a double-acting powered joint. The central spur gear drives a transfer shaft which operates a worm-gear, thereby providing a powerfully driven joint movement between these pivoted struts.

FIG. 30 (Sheet 13) is a perspective view of a twistor drive assembly (twistor pack), wherein the two end pieces of the housing frame are identical, and the top and bottom housing pieces are also identical. These end pieces and top and bottom pieces are adapted to be injection molded of relatively hard plastic.

FIG. 31 is an enlarged perspective view of one of the end pieces or components of the housing frame seen in FIG. 30.

DETAILED DESCRIPTION OF PREFERRED EMBODIMENTS

Figure 3A:
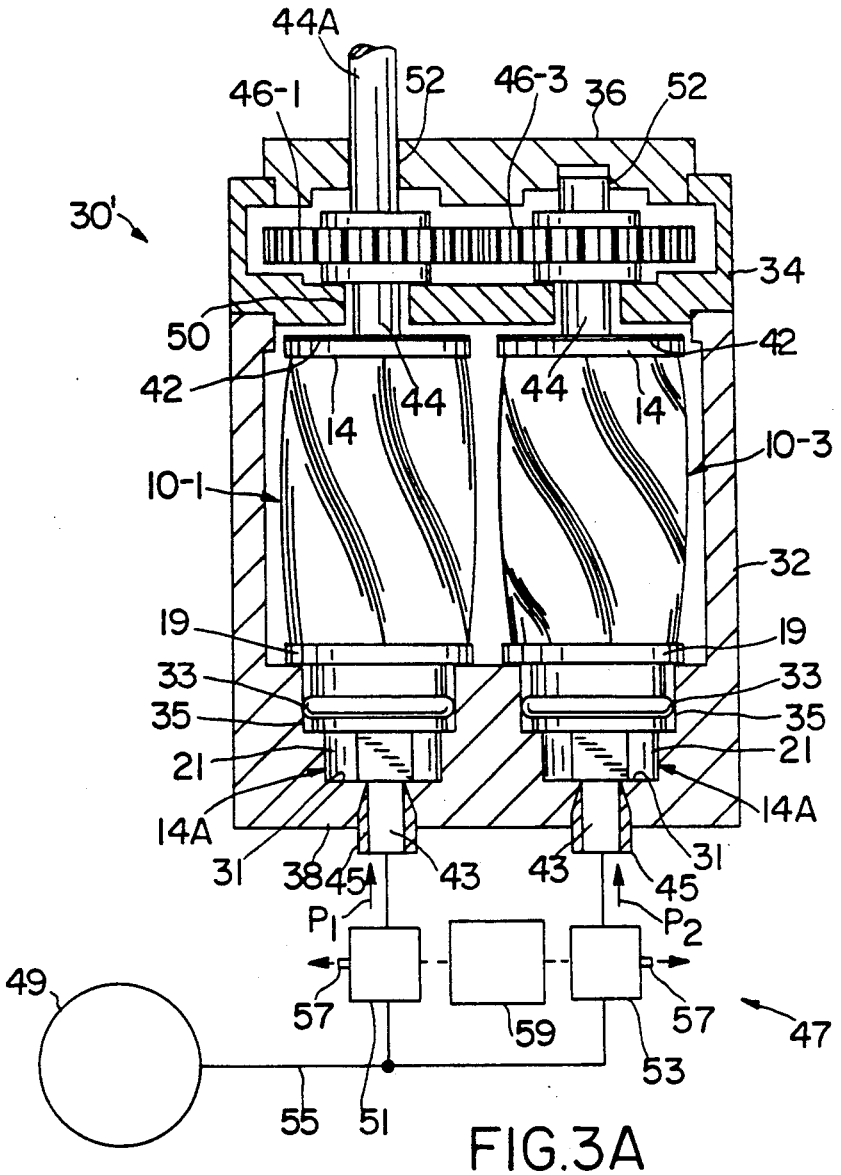
FIG. 3A is an elevational sectional view, similar to FIG. 3, for showing an alternative embodiment of the twistor drive assembly (twistor pack).

Inviting Attention to FIGS. 1, 2 and 2A, there is shown a twistor 10 in its initial untwisted condition having a twistor body 18 comprising tubular wall 12 extending between mounting rims 14 and 16 located at opposite ends of the twistor body. The twistor 10 has a twist axis 15 extending longitudinally through the twistor body 18 concentric with the tubular wall 12, which is shown as having a circular cylindrical shape. The mounting rims 14 and 16 are shown as flanges projecting radially outwardly from opposite ends of the tubular wall 12. It is to be noted that separate end pieces, as shown in FIGS. 1A and 1E, can be mounted on an extruded tubular body 18.

Surrounded by the tubular wall 12 is an internal chamber 11 separated into four longitudinally extending compartments 20 by four reinforcing web-partitions 22 joined together at a common junction 24 extending along the twist axis 15. These partitions are also joined to the tubular wall 12 at four junctions 26 uniformly angularly spaced around the twist axis. These web-partitions 22 are imperforate and are shown as being planar; thus each of the four compartments 20 has a sector sectional shape, as seen in FIGS. 2 and 2A.

The four interior web-partitions 22 together with their common junction 24 have the shape of an equal-arm orthogonal cross as seen in FIGS. 2 and 2A. Since these web-partitions are planar and have a common junction 24 extending along the twist axis, and since the tubular wall 12 is circular cylindrical in shape, it is noted that the four junctions 26 with the tubular wall extend straight and parallel with the twist axis 15, when the twistor body 18 is in its initial untwisted condition as shown in FIGS. 1, 2 and 2A.

The tubular wall 12 and the web-partitions 22 of the twistor body 18 are integrally formed of resilient, tough, elastomeric material, for example, such as polyurethane. This twistor 10, including the tubular wall 12, the interior reinforcing web-partitions 22, and the outwardly projecting mounting rims 14 and 16 can be molded as an integral unit in one molding operation from the same resilient elastomeric material throughout the whole twistor 10. Thus, the cost of such an integrally molded twistor is greatly reduced as compared with any prior composite fluid-pressure-actuatable torsional actuator (twistor) fabricated or built up from various different materials or reinforced with fiber windings or patterns of strands or filaments or braided, woven or knit sleeves or built-up layers.

If desired, the circular cylindrical tubular wall 12 and the web-partitions 22 of the twistor body 18 are molded in one molding operation from the same elastomeric material, for example, by injection molding or by extrusion with the opposite ends of the tubular wall each protruding slightly in the axial direction. Then, the mounting rims 14 and 16 are formed by softening the protruding portions of the tubular wall and re-forming them as outwardly projecting rims. Thus, if desired, the twistor 10 is molded as an integral unit and its ends are then re-formed into the mounting rims 14 and 16. In yet another forming operation the gearing, keyed mounting means, or the feed port at the respective ends of the all-elastomer twistor can also be integrally formed as two separate end pieces, as shown in FIGS. 1A through 1E, and attached to such twistor during its fabrication.

FIGS. 1A through 1E show a twistor 10 in which two end fittings 14A and 16A are attached in air-tight relationship to opposite ends of an extruded body 18 for forming the twistor 10. Each of these end fittings 14A and 16A is shown as having been injection molded from a relatively hard, tough plastic material. Alternatively, these end fittings can be shaped from suitable metal, for example, from aluminum or brass, or may be die-cast. Concentric, axially aligned fluid ports 17 are provided in each of these end fittings 14A and 16A for feeding pressurized fluid, for example, pressurized air, into the compartments 20 of the internal chamber 11 for fluid-powering the twistor 10 in the untwisting direction and for allowing fluid to escape during the re-twisting of the twistor. The twistor body 18 is shown as being secured to the respective end fittings 14A and 16A by encircling ring clamps 19.

Inviting attention to FIGS. 1B, 1C and 1D, it is seen that the outer end portion of each end fitting can have any desired useful configuration. For example, as seen in FIG. 1B, the outer end portion of the end fitting 14A comprises a hexagonal mounting flange 21. This hexagonal mount 21 is adapted to fit into a conforming socket in a frame or housing, and the hexagonal shape serves as keying means for anchoring the fitting to prevent rotation relative to its socket. As shown in FIG. 1C, the outer end portion 23 of an end fitting can have a circular flange configuration adapted to be adhesively secured in mounting relationship to a stationary housing component or adhesively secured to a rotational component of a twistor pack assembly as will be described later.

FIG. 1D shows an appropriate structure for an end fitting 14A or 16A. There are a plurality of cylindrical dentations 25 separated by slots 27. These dentations 25 are equal in number to the number of compartments 20 within the twistor body 18, and the slots 27 equal the number of webs 22. These dentations 25 snugly fit and engage within the tubular wall 12 of the twistor body 18, and the slots 27 snugly receive and engage the internal webs 22 of the extruded twistor body 18. Thus, each encircling ring clamp 19 (FIG. 1A) secures the tubular wall 12 to these dentations 25 with the slots 27 engaging the respective partitions 22.

As shown by the FIG. 1D inset view, the periphery of a circular flange 23 may comprise a spur gear 46 for imparting the rotational drive from the twistor 10. This spur gear 46 may (but need not) have an axially extending stub shaft 44, as shown in dashed outline.

The twistor 10 of FIG. 1E is identical to the twistor shown in FIG. 1A, except that the tubular wall 12 is attached in air-tight relationship to the dentations 25 of the end fittings 14A and 16A by a thin layer of adhesive cement 28.

Figure 3C:
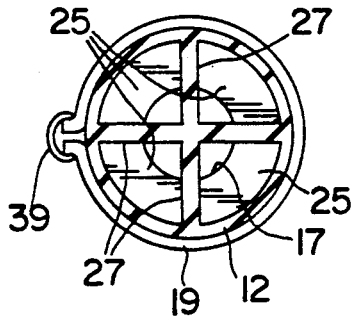
FIG. 3C is a cross-sectional view taken along plane 3C—3C in FIG. 3B showing the internal web-partitions within the twistor body and the clamp encircling the tubular wall. Slots in the end fitting receive and engage the web-partitions.
Figure 3B:
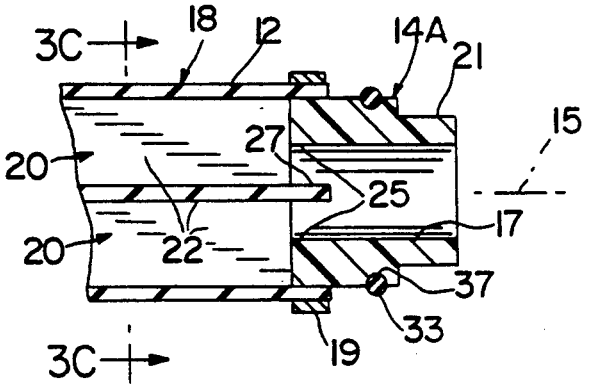
FIG. 3B is a partial elevational sectional view of one of the twistors in the twistor drive assembly of FIG. 3A showing the end fitting attached to the twistor body by an encircling clamp.
Figure 4:
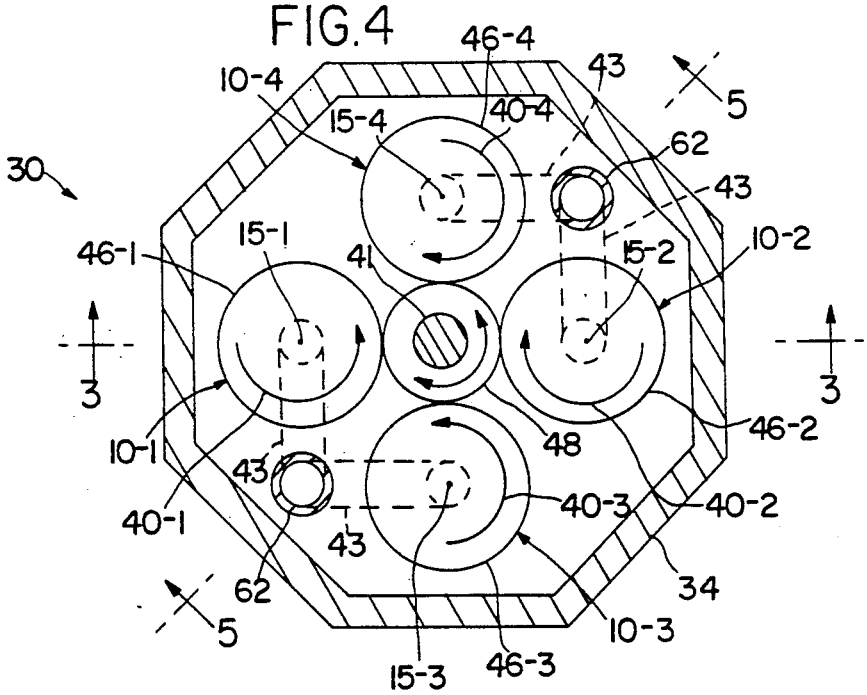
FIG. 4 is a plan cross-sectional view taken along the plane 4—4 in the twistor drive assembly (twistor pack) of FIG. 3 for showing the gearing arrangement for four twistors operating as two opposed pairs.
Figure 5:
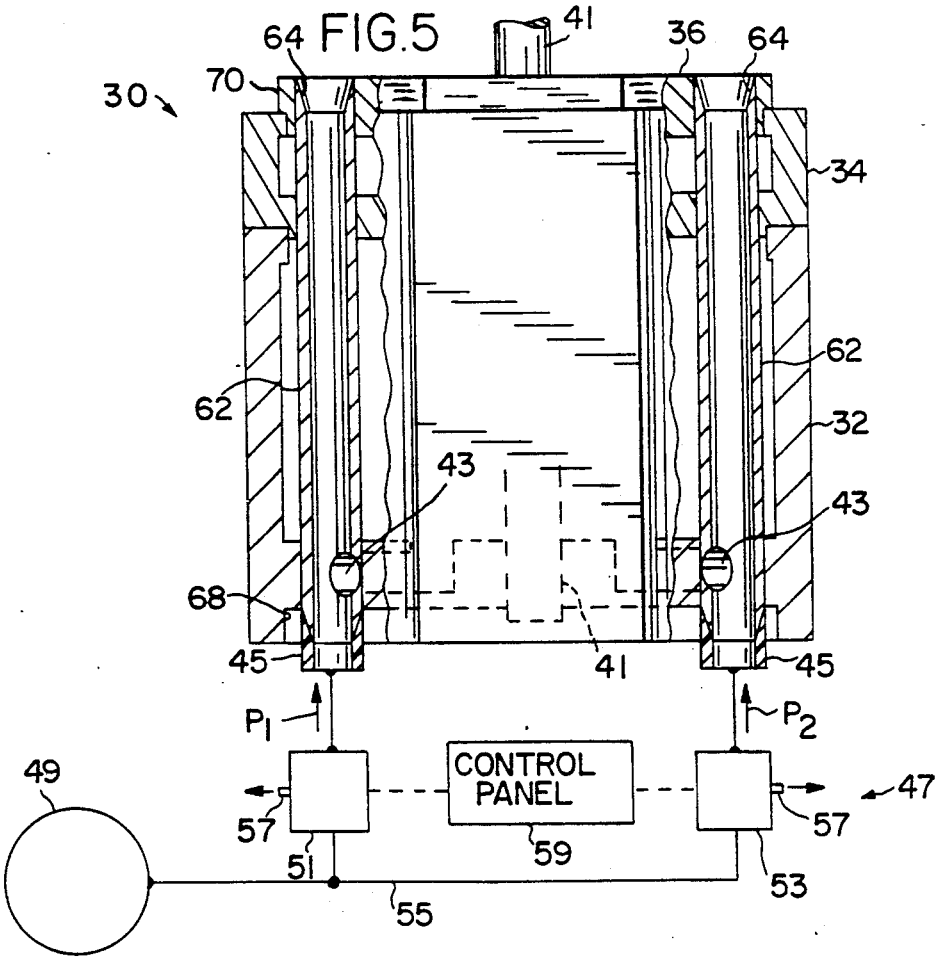
FIG. 5 is a partial elevational sectional view for further showing the fluid feed passages and also for showing a fluid control system for operating the twistor drive assembly of FIGS. 3, 4 and 5 in an open-loop control system.

In the four-twistor drive assembly 30 shown in FIGS. 3, 4 and 5, there is a twistor base housing 32, a gear mount housing 34 and a top cover 36. The twistor base housing 32 includes a base deck 38 to which the mounting flanges or ends 16 or 23 or 21 of four twistors 10-1, 10-2, 10-3 and 10-4 are anchored in fluid-tight relationship, for example by adhesive or by seating in sockets as shown at 31 in FIG. 3A. The two twistors 10-1 and 10-2 constitute an opposed pair as shown by the directional sense of their respective drive arrows 40-1 and 40-2 (FIG. 4, Sheet 4) around their respective twist axes 15-1 and 15-2. Similarly, the other two twistors 10-3 and 10-4 constitute another opposed pair as shown by the directional sense of their respective drive arrows 40-3 and 40-4 around their twist axes 15-3 and 15-4. It is noted that these twist axes 15-1, 15-2, 15-3 and 15-4 are uniformly angularly spaced around a common output driven shaft 41, and these twist axes are equidistant from this driven shaft.

The other mounting rims 14 or 21 of the four twistors are each attached to a rigid disk 42 having a concentric stub shaft 44 projecting from the outer surface of the disk 42 and aligned axially with the twist axis of the respective twistor. The disk 42 blocks on end of each compartment 20 in fluid-tight relationship, for example by adhesive cement attachment of the disk 42 to the mounting rim 14. It is noted that either of the end fittings 14A or 16A, shown in FIGS. 1A through 1E, can be formed with an axially projecting concentric stub shaft 44, rather than being formed with a fluid port 17. Also a spur gear 46 (FIG. 1D) can be formed in addition to a stub shaft 44, as shown in dashed outline in FIG. 1D.

On the respective stub shafts 44 are mounted spur gears 46-1, 46-2, 46-3 and 46-4, which are fastened to their shafts by mechanical attachment, for example, such as by keying or splining. Alternatively, as shown in FIG. 1D, the spur gear 46 and stub shaft 44 can be formed on an end fitting 14A or 16A by molding or machining, in which event the gear mount housing 34 is configured to accommodate the integral stub shaft 44 and spur gear 46 located at the end of the twistors. These spur gears 46 each engages a common spur gear 48 fastened to the common shaft 41, for example by keying or splining.

The stub shafts 44 are rotatably received in clearance openings 50 in the gear mount housing 34, and are journalled in bearings 52 in the top cover 36. The common shaft 41 is rotatably mounted in bearings 54 and 5 in the base and top cover, respectively. There is a clearance opening 56 in the gear mount housing for rotatably receiving the shaft 41.

During fabrication of the twistor drive assembly 30, the opposed pairs of twistors 10-1 and 10-2, 10-3 and 10-4 are pre-twisted by equal amounts in opposite senses, as seen in FIG. 3, before the top cover 36 is installed. By virtue of the fact that the driven common gear 48 is keyed or splined to its shaft 41 by an elongated key or spline 60 (FIGS. 23 and 24, Sheet 9), this driven common gear 48 can be held up out of engagement with the four drive gears 46 while the respective pairs of twistors are pre-twisted in opposite senses. Then, in order to capture the pre-twisted condition of the opposed pairs of twistors, the common gear 48 is slid down along its key or spline 60 into engagement with its drive gears 46, thereby conveniently keeping the pre-twisted twistors in their equal and opposite pre-twisted condition. The cover 36 can be used to retain this driven gear 48 in its desired axial position on the shaft 41. Also, this gear 48 can be adhered to the shaft 48 by strong, fast-setting cement, for example cyanoacrylate glue.

The twistor drive assembly (twistor pack) 30 of FIGS. 3 and 4 may comprise only two opposed twistors 10-1 and 10-2, rather than four as indicated in FIG. 4.

In an alternative embodiment of a twistor drive assembly (twistor pack) 30', as shown in FIG. 3A, the common output shaft 41 and common output gear 48 of FIG. 3 have been omitted. Instead, one of the stub shafts 44 has been extended, as shown at 44A for serving as the output shaft. The gears 46-1 and 46-3 of an opposed pair of twistors 10-1 and 10-3 directly engage each other. If desired, only a pair of opposed twistors 10-1 and 10-3 can comprise the fluid drive of this twistor pack embodiment 30' of FIG. 3A.

It is to be noted, since the common gear 48 is omitted from FIG. 3A and since (as seen in FIG. 4) this common gear caused a reversal of rotational sense as between the gears 46-1 and 46-2, then the result (as shown in FIG. 3A) is that the twist sense of the twistors 10-1 and 10-3 must be the same, so that their mutually engaged gears 46-1 and 46-3 are driving in opposed relationship upon inflation of the respective twistor 10-1 or 10-3.

If it is desired that this twistor pack 30' (without a common shaft 41 and without a common gear 48) comprise four twistors, then the spur gear 46-2 (Please see FIG. 4) engages the spur gear 46-3, so that the twistors 10-2 and 10-3 are aiding each other, and also the fourth spur gear 46-4 engages the first spur gear 46-1, so that the twistors 46-4 and 46-1 are aiding each other. Further, the spur gears 46-2 and 46-4 engage each other. Thus, looking at FIG. 4, the reader will understand that omission of the common shaft 41, and omission of the common gear 48 will permit the four gears 46-1, 46-2, 46-3 and 46-4 to be moved closer to each other in the mutually engaged four-gear relationship, as described in the first two sentences in this paragraph, so that the twistors 10-2 and 10-3 aid each other in their torque action and are providing fluid-driven torque acting in opposition to the fluid-driven torque provided by the twistors 10-1 and 10-4, which, in turn, are aiding each other in their torque action.

The twistors in the twistor stack 30' of FIG. 3A are made with end fittings 14A having hexagonal-shaped mounting ends 21 fitting into hexagonal sockets 31 in the end wall of the base housing 32. Thus, this hexagonal shape serves as keying means for anchoring the end fitting 14A against turning relative to the housing 32, and it will be understood that a key shape or spline shape may also be used to provide such non-rotational keyed engagement with a conforming socket. Also, these end fittings 14A are equipped with encircling O-rings 33 which sealingly engage a cylindrical socket region 35 concentric with the hexagonal socket 31.

Figure 12:
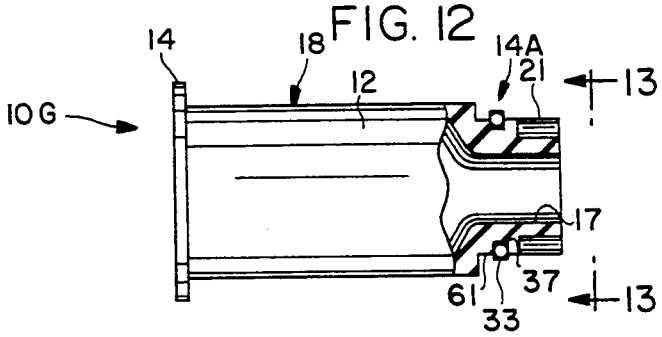
FIG. 12 is an elevational view of an all elastomer twistor having an internal configuration corresponding to any one of the twistors previously shown. An end mounting of this twistor has a keyed (splined) shape with an encircling O-ring for quick easy mounting in sealed (air-tight) relationship in a conforming socket.

As shown in FIGS. 3B and 12, each end fitting 14A in FIG. 3A has a circumferential groove 37 on a circular cylindrical portion 61 of the end fitting for receiving and holding the O-ring 33. There are slots 27 for receiving and engaging the web-partitions 22, with cylindrical dentations 25 engaging the inner surface of the tubular wall 12 which is clamped in air-tight relationship onto the dentations 25 by an encircling clamp ring 19 which is tightly held in place by fastening means 39, for example, such as a spring clip.

The end wall of the housing 32 in FIG. 3A includes fluid passages 43 communicating with the respective fluid ports 17 in the end fittings 14A and also communicating with couplings 45 connected to an open-loop, pressurized-fluid control system 47, which includes a source 49 of pressurized fluid, for example compressed air.

In this open-loop, pressurized-fluid control system 47, pressurized fluid is supplied from its source 49 through a supply line 55 leading to first and second fluid-pressure control means 51 and 53 for controlling the respective fluid pressure levels P1 and P2 within the chamber 11 inside of the respective twistors 10-1 and 10-3. These fluid-pressure control means 51 and 53 are connected through couplings 45 to the fluid passages 43 and may comprise any suitable, controllable pressure-regulating means having vents 57 to the atmosphere. For example, if the twistor drive assembly (twistor pack) 30 or 30' includes only two opposed twistor-pairs, i.e. involving only two inlet ports 17, then, for example, these controllable pressure-regulating means 51 and 53 may comprise a pneumatic bridge having a programmable control panel 59, such as described and shown in FIG. 4 of U.S. Pat. No. 4,784,042, issued Nov. 15, 1988, in my name as inventor. Such a pneumatic bridge is adapted to supply fluid pressures;

$$P1 = Po \pm \Delta P \quad (1)$$

$$P2 = Po \mp \Delta P \quad (2)$$

wherein "Po" is a suitable predetermined and adjustable reference pressure level, and "ΔP" is a controllable pressure increment above or below the reference pressure level Po. Thus, as P1 is controllably increased above Po, P2 is controllably reduced by a corresponding increment below Po; and vice versa.

If the twistor drive assembly 30 or 30' includes four opposed twistor-pairs or six opposed twistor-pairs or eight opposed twistor pairs, etc., then the fluid passages 43 are suitably arranged for providing the respective fluid pressure levels P1 and P2 in appropriate relationship to all of the respective twistor ports 17.

Figure 6:
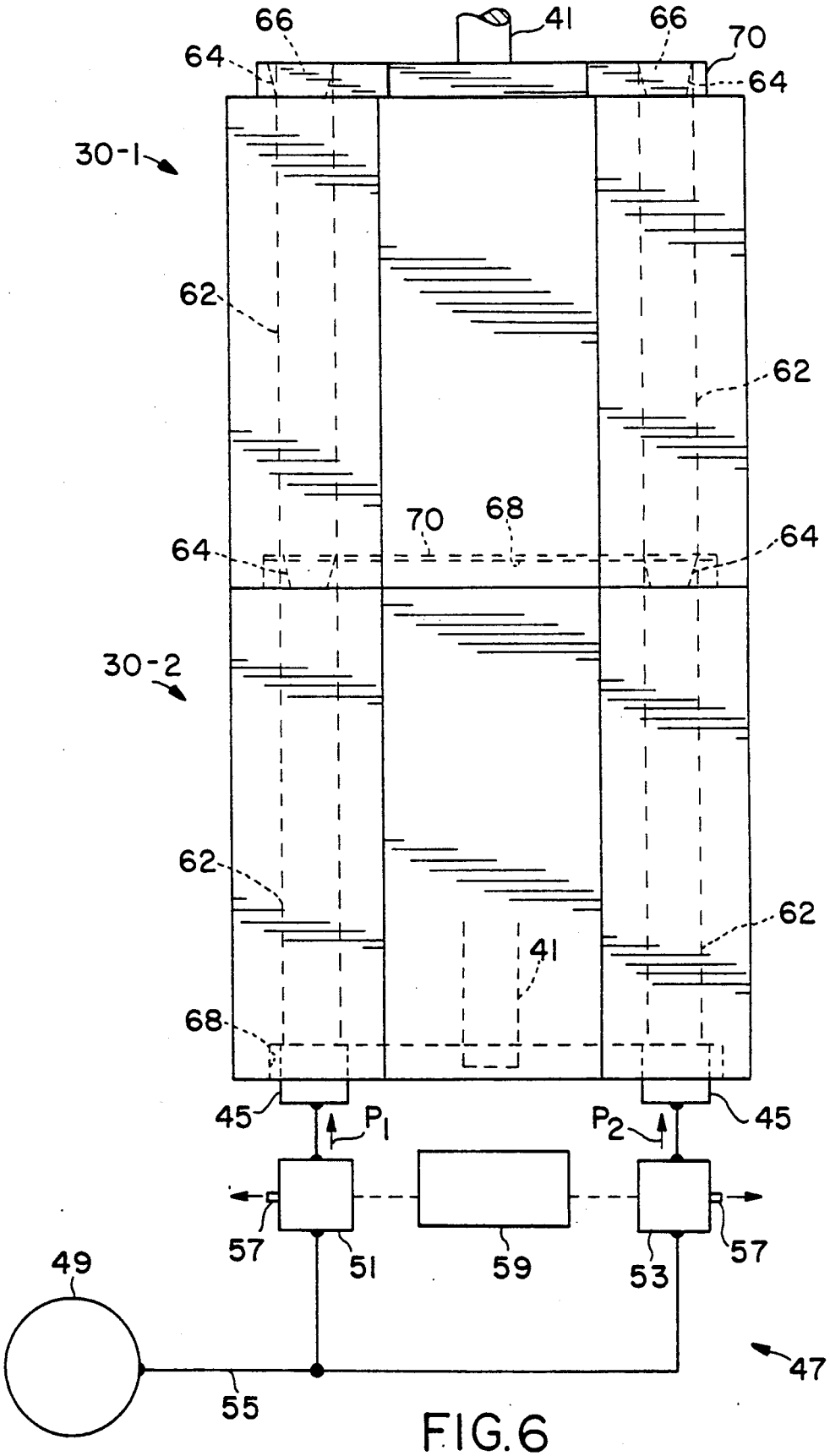
FIG. 6 shows the convenient manner in which multiple twistor drive assemblies can be stacked in end-to-end array for adding together their turning moments applied to a common output shaft extending through the entire stack.

In FIGS. 4 and 5 the controllable fluid pressures P1 and P2 are supplied through couplings 45 communicating with feed tubes 62, which, in turn, communicate through fluid passages 43 with the interiors 11 of the respective twistors. As seen in FIG. 4, the passages 43 branch off from the respective feed tubes 62 for communicating with the interiors 11 of respective twistors 10-1, 10-2, 10-3 and 10-4. In FIG. 4, the twistors 10-1 and 10-3 aid each other; the twistors 10-2 and 10-4 also aid each other; and twistors 10-1 and 10-3 are operating in opposed relationship to twistors 10-2 and 10-4. FIG. 5 shows that feed tubes 62 extend in an axial direction through the twistor pack 30 with coupling means 64, for example, a taper-lock socket, being provided at the upper ends of these feed tubes 62. The coupling means 64 are provided so that a plurality of these twistor packs 30 can be stacked together in end-to-end relationship, as shown in FIG. 6. Thus, the feed tubes 62 extend continuously through a whole stack 30-1, 30-2, etc., as shown in FIG. 6. The coupling means 64 at the upper ends of the feed tubes in the last twistor pack 30-1 are plugged, as shown at 66 in FIG. 6.

If there is only a single twistor pack 30, as shown in FIG. 5, then the coupling means 64 at the upper ends of the feed tubes 62 are plugged.

As shown in FIG. 4, the housing 32, 34 of a twistor pack 30 may have an overall polygonal configuration, for example, an octagonal shape, as seen looking in a direction parallel with the rotational axes 15 of the twistors, i.e., as seen in a direction parallel with the common output shaft 41. For accommodating convenient stacking alignment, as seen in FIG. 6, the base housing 32 has a shallow polygonal (octagonal) socket 68 (FIG. 6) and the cover 36 has a shallow raised deck 70 of polygonal (octagonal) configuration for fitting snugly into the socket 68 of the adjoining twistor pack in a stack 30-1, 30-2, etc.

Figure 7:
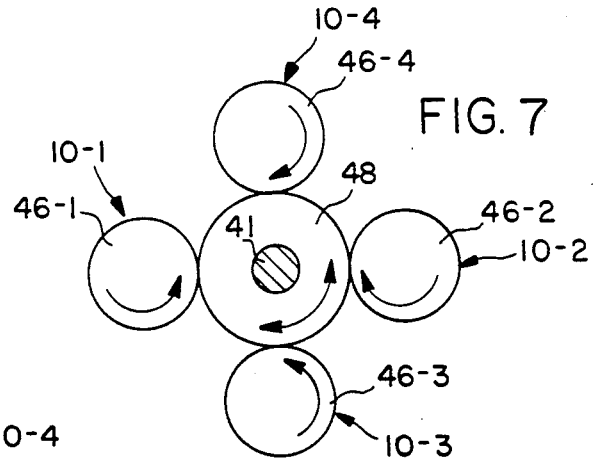
FIG. 7 (on Sheet 7) is a partial plan sectional view taken along a plane corresponding to the plane 4—4 in FIG. 3 for showing a different gear ratio from that seen in FIG. 4.

In the twistor drive arrangement shown in FIG. 7, the the fluid-driven twistors 10-1 and 10-3 are aiding each other in torque output; the fluid-driven twistors 10-2 and 10-4 are aiding each other in torque output; and the twistors 10-1 and 10-3 are fluid-driven in the opposite torque sense from the twistors 10-2 and 10-4.

Figure 7A:
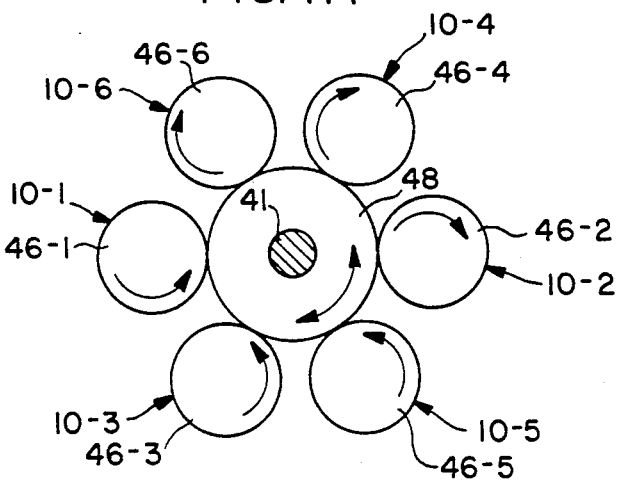
FIG. 7A shows a gearing arrangement for a six-twistor drive assembly (six-twistor pack).

In the twistor drive arrangement shown in FIG. 7A, the fluid-driven twistors 10-1, 10-3 and 10-5 are aiding each other in torque output; the fluid-driven twistors 10-2, 10-4 and 10-6 are aiding each other in torque output; and the twistors 10-1, 10-3 and 10-5 are fluid-driven in the opposite torque sense from the twistors 10-2, 10-4 and 10-6.

The twistor 10A in FIG. 8 includes circular openings 72 in the webs 22 of the twistor body 18 for increasing torsional flexibility of this twistor 10A. Thus, fluid communication can occur through these openings 72, and so the sector-shaped compartments 20 (FIG. 2A) of the internal chamber 11 are not isolated from each other.

The twistor 10B in FIG. 9 includes square openings 74 in the webs 22 of its twistor body 18 for increasing the torsional flexibility of this twistor 10B. As discussed above regarding the twistor 10A, in this twistor 10B there is fluid communication through the openings 74 in the webs 22, and so the sector-shaped compartments 20 (FIG. 2A) of the internal chamber 11 are not isolated one from another.

In FIGS. 10 and 10A is shown a twistor 10C, wherein the circular tubular wall 12 of the twistor body 18 includes integrally formed internally projecting rib webs 22A of isosceles triangular cross-sectional shape, as seen in FIG. 10A. This twistor body 18, as shown in FIGS. 10 and 10A, is adapted to be formed by extrusion of tough, flexible elastomeric material, for example, polyurethane.

FIG. 10B shows a twistor 10D, wherein the twistor body 18 has a circular tubular wall 12 in its untwisted state, including integrally formed web partitions 22 meeting at an on-axis common junction 24 separating the internal chamber 11 into multiple, axially extending compartments 20, which are isolated one from another. There are integrally formed fillets 76 at the juncture 26 of each web-partition with the tubular wall 12. A twistor body 18 of the shape shown in FIG. 10B is adapted to be formed from tough, flexible elastomer by extrusion.

In FIG. 11B is shown a cross-sectional view of a twistor 10E in which the twistor body 18 has a circular tubular wall 12 in its untwisted state including eight web-partitions 22 which divide the internal chamber 11 into eight sector-shaped compartments 20 extending longitudinally within the twistor body and isolated one from another. These web-partitions 22 meet at a common on-axis junction 24 and are integrally joined with the tubular wall along junctions 26 extending parallel with the axis of the twistor 10E. A twistor body 18 of the shape shown in FIG. 11B is adapted to be formed by extrusion from a tough, flexible elastomer.

Figure 11:
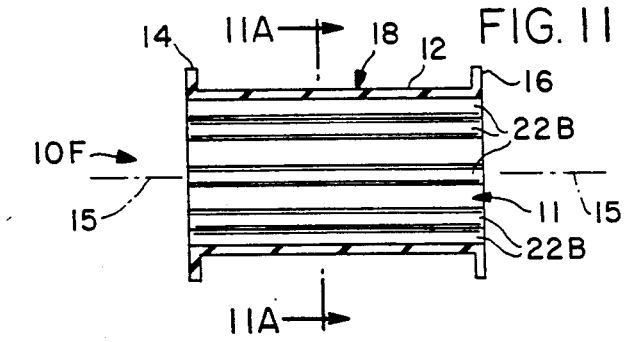
FIG. 11 is a longitudinal sectional view of a twistor body similar to FIGS. 1, 1E and 10 in which the reinforcing webs have generally rounded shapes as seen in FIG. 11A, a cross section taken along the plane 11A—11A in FIG. 11.
Figure 11A:
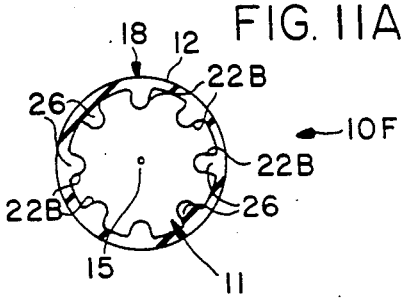
FIG. 11B is a cross-sectional view of a twistor body formed, for example, by extrusion in which there are eight partitions dividing the interior of the tubular wall into eight sector-shaped compartments.

In FIGS. 11 and 11A is shown a twistor 10F wherein the twistor body 18 has a circular tubular wall 12 with eight rounded rib-shaped webs 22B integrally formed with the tubular wall along axially extending junctions 26, for example, this twistor body 18 being formed by extrusion.

Figure 13:
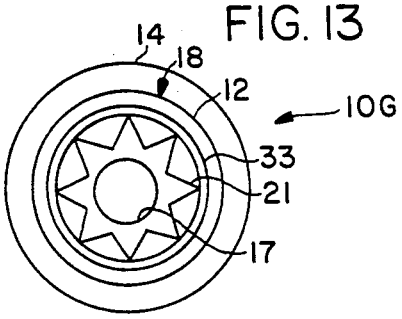
FIG. 13 is an end elevational view of the twistor of FIG. 12 as seen from the position 13—13 in FIG. 12 and showing further details of the keyed (splined) mounting end.

The twistor 10G shown in FIGS. 12 and 13 is made with an integrally formed mounting end fitting 14A having a splined mounting end 21 for mounting in keyed engaged relationship into a conforming socket in a housing, for example, generally similar to the socket 31 in FIG. 3A, except that this socket would be splined to mate with the splined mounting end 21 in FIGS. 12 and 13. An encircling O-ring 33 is received in a circumferential groove 37 on a circular cylindrical portion 61 of this end fitting. It will be understood from FIGS. 1A through 1E, and also from FIGS. 3A through 3C that the end fitting 14A in FIGS. 12 and 13 can be formed separately from the twistor body 18 and then appropriately be secured thereto in air-tight relationship, as previously explained.

MULTI TWISTORS ON THE SAME TWIST AXIS ON OPPOSITE SIDES OF AN INTERMEDIATE DRIVE GEAR

In the preceding portions of this specification, there was shown and described a single twistor located on each twist axis 15 in each twistor drive assembly (twistor pack) 30. The drive gear 46 was located at one end of the single twistor, and a stub shaft 44 with a bearing 52 was used to keep the desired rotational position of the drive gear 46. The other end of the single twistor on each axis 15 was mounted to a housing or frame, as shown in FIGS. 3 and 3A.

FIGS. 14 and 15 show a twistor drive assembly (twistor pack) 30A in which a plurality of twistors 10-1 and 10-2 are located on the same twist axis. A pair of twistors 10-1 and 10-2 on one and the same twist axis are attached to their drive gear 46-1 on opposite sides in a monolithic twistor-pair drive arrangement. This spur drive gear 46-1 engages a common spur gear (driven gear) 48 on a common output shaft 41. Another pair of twistors 10-1 and 10-2 on another twist axis are attached to their drive gear 46-3 in another monolithic twistor-pair drive arrangement. This spur drive gear 46-3 also engages the common gear 48. Each monolithic pair of twistors is helically twisted in the same sense, thus providing both forward (F) and reverse (R) fluid-driven torque, as is indicated in FIG. 15 by the notations "F,R".

The housing includes a side 32 and two ends 38, with the twistor ends 16 or 23 or 21 being anchored in non-rotational, air-tight relationship to these respective ends 38 of the housing. The twistor ends 16 or 23 or 21 may be anchored to the housing ends 38 by adhesive cement or by mounting them in sockets, as shown in FIG. 3A. The housing ends 38 include fluid passages 43 communicating with the interiors of the respective twistors. It will be understood that the interiors of these twistors 10-1 and 10-2 in FIGS. 14 and 15 may have any of the various configurations shown for the twistor bodies 18 in FIGS. 1, 1A, 1B, 1C, 1E, 2A, 3B, 3C, 8, 9, 10, 10A, 10B, 11, 11A and 11B. At the present time, my preference for the best mode is for those configurations of twistor bodies 18 in which the internal webs 22 are integrally joined together along an on-axis juncture 24, because this joining 24 of the webs 22 along the twist axis 15 resists undesired ballooning of the tubular wall 12 and thereby enables higher fluid pressures P1 and P2 to be used for providing increased torque drive from each twistor. The fluid pressure P1 is fed into the interiors of the twistors 10-1 for producing forward (F) torque drive (clockwise) in FIG. 15 for turning the shaft 41 counterclockwise. Conversely, the pressure P2 is fed into the interiors of the twistors 10-2 for producing reverse (R) torque drive (counterclockwise) in FIG. 15 for turning the shaft 41 clockwise. In FIG. 14, the interior of the twistors 10-1 do not communicate through the respective gear 46-1 or 46-3 with the interior of the twistors 10-2.

It is noted that this twistor drive assembly 30A utilizes the unique flexural properties of monolithic twistor-pairs 10-1 and 10-2 on a common twist axis in an improved multiple twistor torque drive which is an improvement upon the combined joint and motor drive arrangement taught in my U.S. Pat. No. 4,751,868. Only two shaft bushings or bearings 54 and 58 (FIG. 14) are required for rotatably mounting the common output shaft 41, even though four monolithic twistor pairs 10-1 and 10-2 comprising a total of eight twistors are employed in the twistor pack 30A of FIGS. 14 and 15.

FIGS. 16 and 17 show a twistor drive assembly (twistor pack) 30B which is generally similar to the twistor pack 30A in FIGS. 14 and 15, except that there is a port 78 through each gear 46-1 and 46-2, so that the interiors of the two twistors 10-1 on a common twist axis communicate with each other, and also the interiors of the two twistors 10-2 on a common twist axis communicate with each other. The two common-axis twistors 10-1 are helically twisted in opposite senses, as seen in FIG. 16, and the two common-axis twistors 10-2 are also twisted in opposite senses. Thus, the two common-axis twistors 10-1 aid each other in providing fluid-driven forward (F) torque drive in the clockwise direction in FIG. 17. Since these pairs of twistors 10-1 are in aiding relationship in the forward direction around their common twist axis, the notations "2F" are shown for twistors 10-1 in FIG. 17. Similarly, the two twistors 10-2 aid each other in providing fluid-driven reverse (R) torque drive in the counterclockwise direction in FIG. 17. The notations "2R" are shown in FIG. 17 for indicating that the pairs of twistors 10-2 are aiding each other in the reverse (R) counterclockwise direction around their common twist axis.

By virtue of the fact that there is a through-the-gear port 78 (FIG. 16), it is only necessary to provide fluid connections 43 through one of the housing ends 38 of this twistor pack 30B, as is shown by the solid-line fluid pressure connections P1 and P2 at the left side in FIG. 16. The dashed-line connections P1 and P2 are shown at the right side of FIG. 16 to emphasize that this twistor drive arrangement 30B in FIGS. 16 and 17 advantageously enables all of the fluid connections P1 and P2 to be made at only one end of the housing.

As discussed above for the twistor pack 30A, the twistor pack 30B also needs only two shaft bushings or bearings 54 and 58 for rotatably mounting the common output shaft 41, even though four monolithic twistor-pairs 10-1 and 10-1, 10-2 and 10-2 comprising a total of eight twistors are employed in this twistor pack 30B.

FIGS. 18 and 19 show a twistor drive assembly (twistor pack) 30C which is similar to the twistor pack 30A of FIGS. 14 and 15, except that a total of eight monolithic twistor-pairs comprising a total of sixteen twistors are employed in this twistor pack 30C. Therefore, this twistor pack 30C is a relatively compact and powerful double-acting fluid-driven torque drive unit in which a total of eight twistor 10-1 are fluid-driven in the forward F direction and a total of eight twistors 10-2 are fluid-driven in the reverse R direction.

The twistor ends or 21 can be mounted in air-tight relationship to the housing ends 3 by adhesive cement attachment or by keyed engagement in sockets, as shown in FIG. 3A.

It is to be noted in FIG. 19 that the twistor-pairs on a common twist axis are bowed relative to the common driven gear 48 in a bow-legged (convex outward) relationship. This same bow-legged relationship is shown in FIGS. 14 and 16, but is more clearly illustrated in FIG. 19. Looking at FIG. 18, it is to be understood that the twistor-pair on a respective common twist axis which engage the respective drive gears 46-3 are similarly bowed convex outwardly relative to their common driven gear 48. Moreover, the four twistor-pairs on the respective four common twist axes at the four corners of the gear pattern shown in plan view in FIG. 18 are mounted in bowed relationship convex outwardly along the respective 45 degree diagonal lines 80 and 82 relative to the engagement of their drive gear 46-2 or 46-4 with the respective driven gears 46-1 and 46-3. Whereas the four twistor-pairs located at the mid-positions of the respective four sides of the square pattern shown in FIG. 18 each serves to drive only the one common driven gear 48, the four twistor pairs located at the respective corners of this square pattern (i.e. the four twistor-pairs located on the diagonals 80 and 82) serve to drive two driven gears, namely, the gears in the two adjacent twistor pairs.

The purpose and function of the bowed mounting relationship of the twistor-pairs will be explained in detail in connection with FIG. 33.

Figure 20:
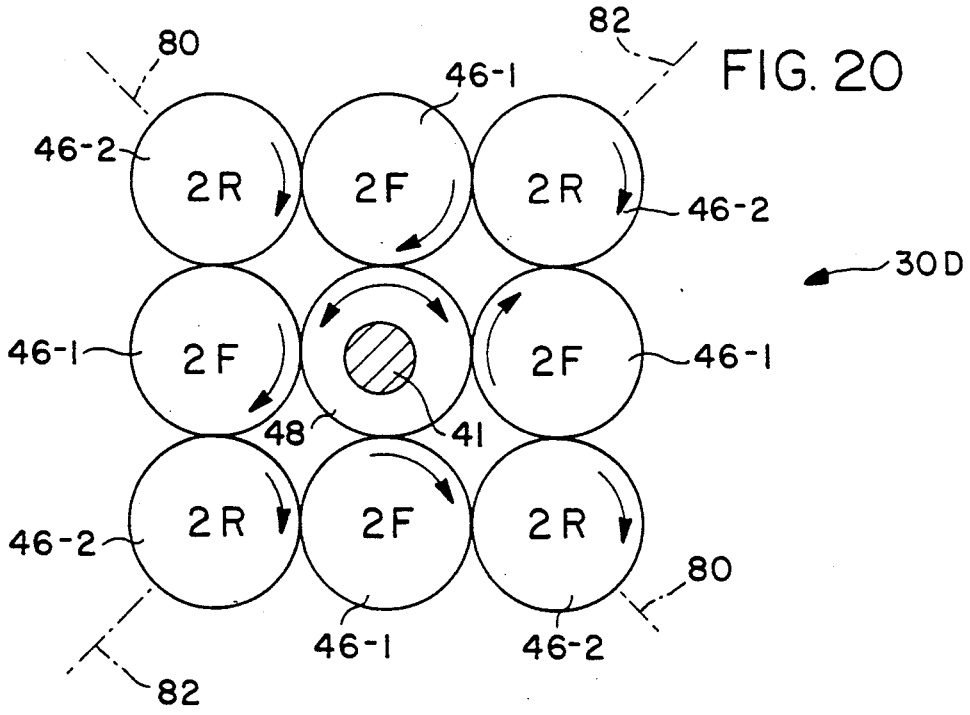
FIG. 20 depicts a gearing arrangement similar to FIG. 18, in which four forward drive twistor-pairs (2F) engage directly with the centrally-located shaft gear, and four more reverse drive twistor-pairs (2R) engage only with the adjacent gears of the forward drive twistors. Each of these forward drive twistor-pairs (2F) is similar to the forward drive twistor pair shown in FIG. 16, and each of these reverse drive twistor-pairs 2R is similar to the reverse drive twistor-pair shown in FIG. 16.

In FIG. 20 is shown a twistor drive assembly (twistor pack) 30D which is similar to the twistor pack 30B of FIGS. 16 and 17, except that a total of eight monolithic twistor-pairs comprising a total of sixteen twistors are employed. Consequently, this twistor pack 30D is a relatively compact and powerful double-acting fluid-driven torque drive unit in which a total of eight twistors provide the respective four "2F" drives and a total of eight twistors provide the respective four "2R" drives. Each of the twistor-pairs on a common twist axis in FIG. 20 are bowed convex outwardly relative to the engagement of their drive gear with each driven gear similar to the arrangement, as explained in FIGS. 18 and 19.

Figure 21:
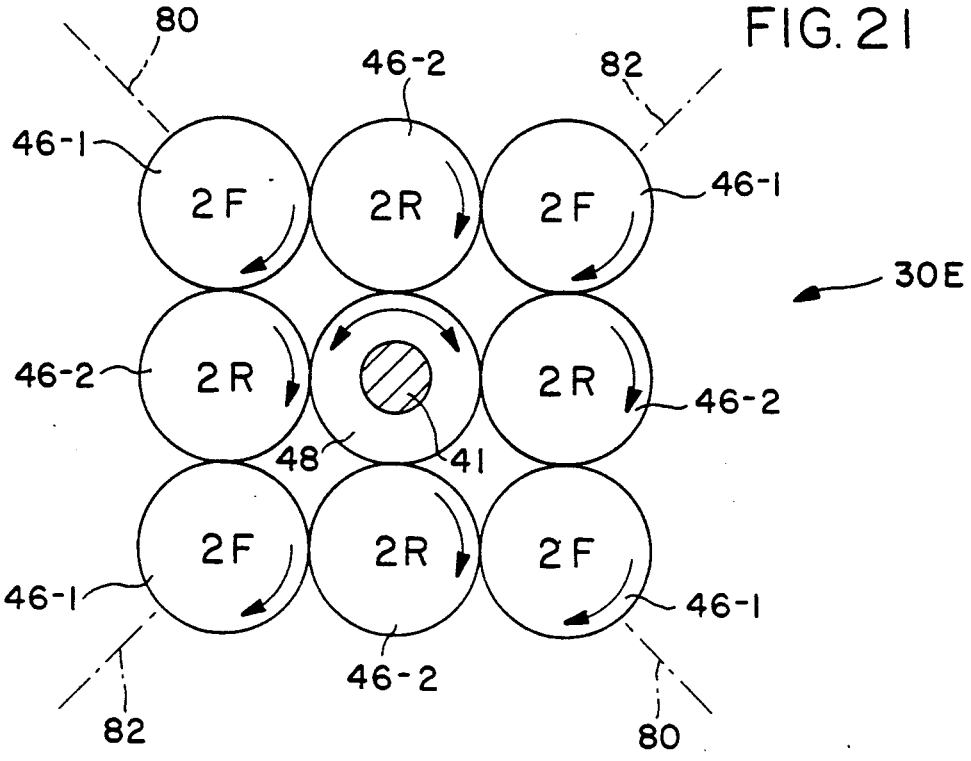
FIG. 21 shows a gearing arrangement similar to FIGS. 18 and 20. In comparing FIG. 21 with FIG. 20, it is seen that the relative positions of the four forward drive twistor-pairs (2F) are interchanged with the relative positions of the four reverse drive twistor-pairs (2R).

FIG. 21 shows a twistor drive assembly (twistor pack) 30E which is identical to the twistor pack 30D, except that the relative positions of the "2F" and "2R" twistor-pairs are interchanged with respect to their positions, as shown in FIG. 20. In other words, FIG. 21 along with FIGS. 15, 17, 18 and 20 illustrate the flexibility of the twistor drive configurations which can be provided.

Additional twistor-pairs can be assembled around the periphery of the square patterns shown in FIGS. 15, 17, 18, 20 and 21 if greater torque output is desired. Nevertheless, only one output shaft 41 with only two bushings or bearings 54 and 58 are needed, regardless of the total number of twistor-pairs.

Figure 22:
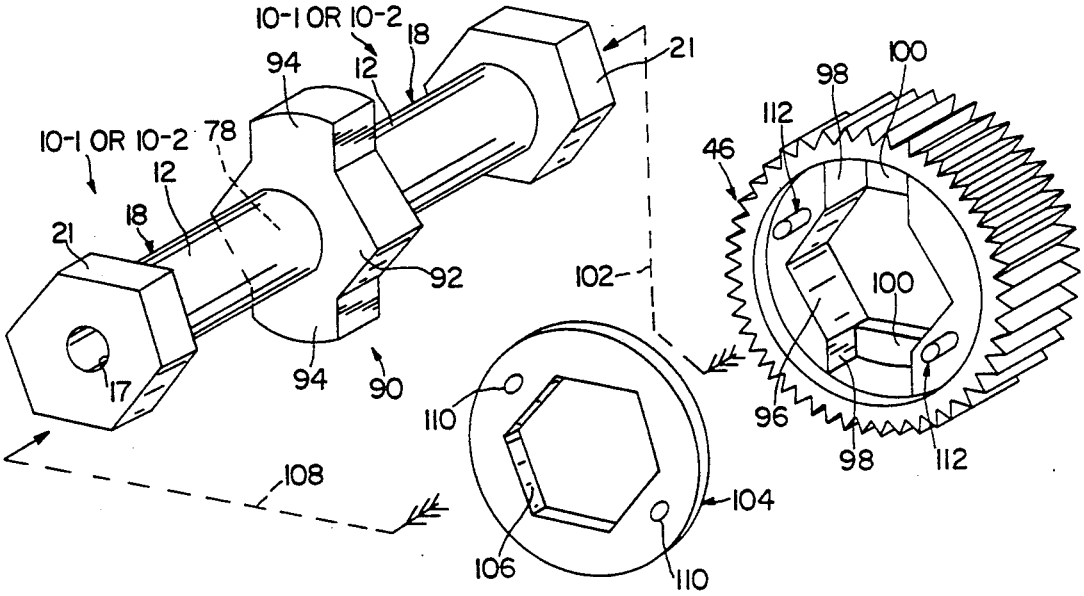
FIG. 22 is a disassembled perspective view.

FIG. 22 shows a common twist axis twistor-pair 10-1 or 10-2 which is adapted to be injection molded as one monolithic integral fluid-driven torque unit 90. Depending upon the final twist directions of their twistor bodies 18, and depending upon their fluid feed arrangement, this monolithic torque unit 90 may comprise two forward drive twistors 10-1 and 10-1 or may comprise two reverse drive twistors 10-2 and 10-2, or may comprise a double-acting twistor pair 10-1 and 10-2. A central fluid port 78 may be provided or may be omitted, depending upon the desired fluid feed arrangement. Each end of this fluid-driven twistor-pair has a hexagonal mounting flange 21 for keyed engagement into a housing socket.

There is a central hub 92 of hexagonal shape having a pair of lugs 94 projecting from opposite corners of the hexagon. This hub hexagon is slightly larger in peripheral size than the two hexagonal end mounts 21, which are of equal size.

A ring gear 46 has an axial aperture 96 adapted snugly to engage and seat upon the hub 92. Thus, this aperture 96 has a hexagonal shape with two diametrically opposed extending recesses 98 for seating on the lugs 94. One axial side of each recess 98 is closed by a wall 100. Thus, as shown by a dashed arrow 102, this ring gear 46 can be assembled with its hub 92 by passing the aperture 96 over one of the hexagonal end mounts 21 and then positioning the recesses 98 onto the lugs 94 with the two walls 100 flush against surfaces of these lugs. A retainer ring 104 having a central hexagonal opening 106 slightly larger than an end mount 21 is passed over the other end mount 21, as shown by a dashed arrow 108. This retainer ring abuts flush against the opposite surfaces of the lugs 94 from the recess walls 100 of the ring gear 46. In order to capture the lugs 94 in the recesses 98, the retainer ring has two relatively small holes 110 which fasten to two pins 112 on the ring gear 46.

FIG. 25 shows a stack 120 of twistor packs 30 for turning a common shaft 41 in alternate forward and reverse directions, as indicted by the legend "Nutation" and by the double-headed curved arrow 122. Limit switches 124 are responsive to the rotation of the shaft 41 in opposite directions 122 for controlling the respective fluid-pressure controls 51 and 53, for example, shown as three-way valves, each with a vent 57 to atmosphere. For example, these valves 51 and 53 are solenoid actuated for electrical control operation by the limit switches 124.

The nutating shaft 41 is connected to a reversible sprag 126 (one-way drive clutch) for rotating an output shaft 128 with continuous rotation 130. The direction of this continuous rotation 130 is determined by setting the reversible sprag 126 in a "Forward" or "Reverse" direction, as may be desired by the user.

STRING OF TWISTORS ON A COMMON TWIST AXIS

In the preceding portions of the specification, each twistor 10 was located adjacent to its drive gear 46. A single twistor 10 was adjacent to its drive 46, as shown in FIGS. 3 and 3A. A pair of twistors 10 were on opposite sides of their common drive gear 46 in FIGS. 14, 16 and 19, so that each twistor was adjacent to its drive gear.

Figure 29:
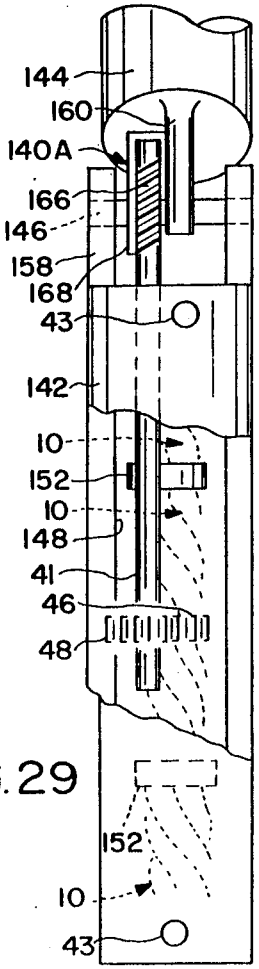
FIG. 29 shows a side elevational view of the double-acting fluid-power-driven jointed strut arrangement of FIG. 28. A portion of a strut in FIG. 29 is broken away for showing the twistor string located within the tubular strut.
Figure 28:
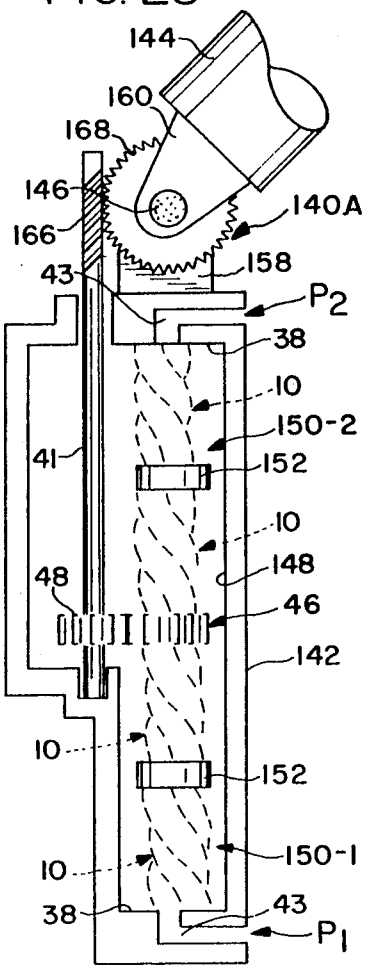
FIG. 28 is an elevational sectional view of a jointed strut arrangement generally similar to FIG. 27, except that the twistor string in FIG. 28 has a central output spur gear with two forward-drive twistors in series on one side of this central gear and two reverse-drive twistors in series on the other side of this central gear; thus, two fluid inlet ports are provided. In other words.
Figure 27:
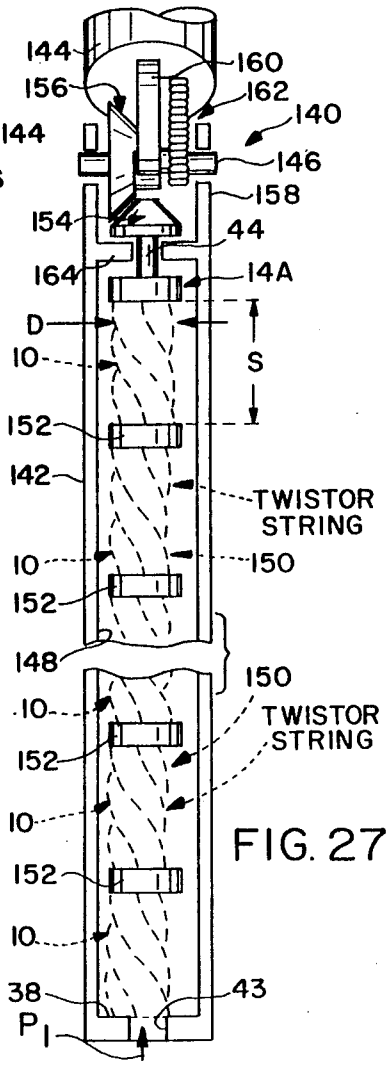
FIG. 27 is an elevational sectional view of the joint arrangement of FIG. 26 showing a twistor string-mounted within a tubular strut for turning one of the bevel gears. All of these twistors in this twistor string drive in the same direction, which may be considered the fluid-driven-powered forward direction, and the return spring may be considered as moving the joint in the reverse direction. Since all of these twistors now drive in the same direction, only one fluid inlet port is used.

A further twistor drive arrangement, as shown in FIGS. 27, 28 and 29, provides a "string" of twistors on a common twist axis, such that at least one twistor 10 in the string is located away from its drive gear 46 and is connected to its drive gear through at least one intervening twistor. Thus, a "string" of twistors is defined as comprising at least two twistors on a common twist axis and being connected axially end-to-end and both located on the same axial side of their drive gear.

Figure 26:
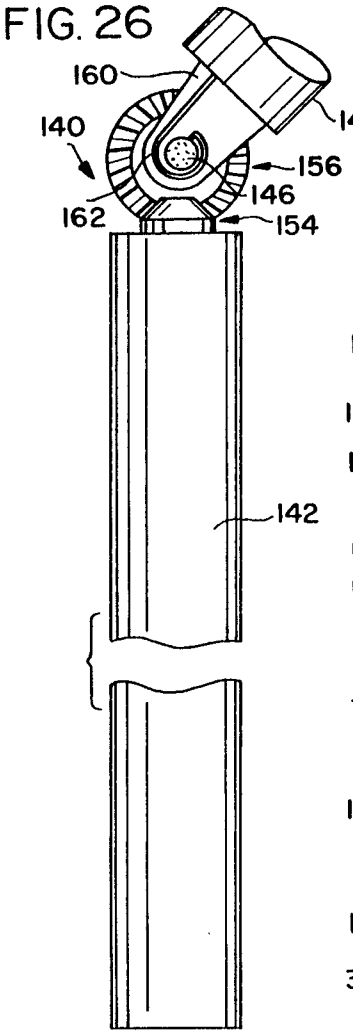
FIG. 26 (Sheet 13) is an elevational view of a fluid-driven, single-acting jointed strut arrangement suitable for use as an arm in a manipulator or for use as an arm or leg in a robot. This pivoted joint is fluid-power-driven in one direction by a twistor string acting through a bevel-gear drive and is moved back in the other direction by a return spring.

FIGS. 26 and 27 show a single-acting fluid-powered joint 140 between two struts 142 and 144 pivotally hinged together at 146 for providing joint action between these struts 142, 144. The strut 142 is a tube strut having an axial bore 148 (FIG. 27), and a twistor string 150 extends axially within this bore 148. This twistor string 150 comprises a multiplicity of twistors 10 on a common twist axis connected in end-to-end relationship with their interiors communicating with each other. There is a fluid passage 43 in the lower end 38 of the strut 142, and the lower end of the twistor string 150 is anchored to this strut end 38 in air-tight relationship around the passage 43, so that a controllable fluid pressure "P1" can be fed into the interiors of all of the twistors through one end of the string 150.

There are a series of ring clamps 152 encircling the string 150 between the respective twistors 10. These ring clamps 152 are uniformly spaced apart in the axial direction by an axial distance "S" having a length in the range of about 1.5 to about 3.0 times the outside diameter "D" of the twistors 10 in untwisted condition. The upper end of the twistor string 150 is terminated by an end fitting 14A having a stub shaft 44 secured to a first bevel gear 154 engaging a second bevel gear 156 secured to the pivot shaft 146. This pivot shaft 146 is journalled in bearings in a clevis 158 formed on the upper end of the strut 142 and is connected by a hinge element 160 to the hinge end of the second strut 144, which may also be tubular, if desired.

Because each twistor 10 in the string 150 can readily supply in excess of 60 degrees of rotation, the total number "N" of the twistors 10 can supply $60 \times N$ degrees of rotation, which can be usefully geared down by a smaller diameter bevel gear 154 driving a larger diameter bevel gear 156 for increasing the torque of this joint 140. A leaf spring return 162 is connected to the upper strut 144 and curves around the joint pivot shaft 146 and is anchored to the clevis 158.

The twistor string 150 is placed under adequate depressured tension in order to prevent a corkscrew effect. In order to provide tension, the underside of the first bevel gear 154 serves as a thrust bearing engaging against an upper end wall 164 of the first strut 142. This ambient tension level also tends to improve the torque output of the twistor.

FIGS. 28 and 29 show a double-acting fluid powered joint 140A. There are first and second twistor strings 150-1 and 150-2, respectively, on opposite sides of and attached to their spur drive gear 46 which engages a driven spur gear 48 on a transfer shaft 41 having a worm gear 166 engaging a driven worm gear 168 connected to the joint pivot shaft 146 which, in turn, is secured to a hinge element 160 connected to the lower end of the upper strut 144. The lower end of the first twistor string 150-1 is anchored to the lower end wall 38 in air-tight relation encircling the lower fluid passage 43 supplied with fluid pressure P1 and the upper end of the second twistor string 150-2 is anchored to an upper end wall 38 in air-tight relation encircling an upper fluid passage 43 supplied with fluid pressure P2. Again, initial axial tension augments the radial engagement force and improves performance.

It is to be understood from FIGS. 26 through 29 that the struts 142 and 144 can serve as shanks in an arm of a manipulator or robot having an arm joint 140 or 140A or can serve as shanks in the leg of a robot having a knee or ankle joint 140 or 140A.

Figure 32:
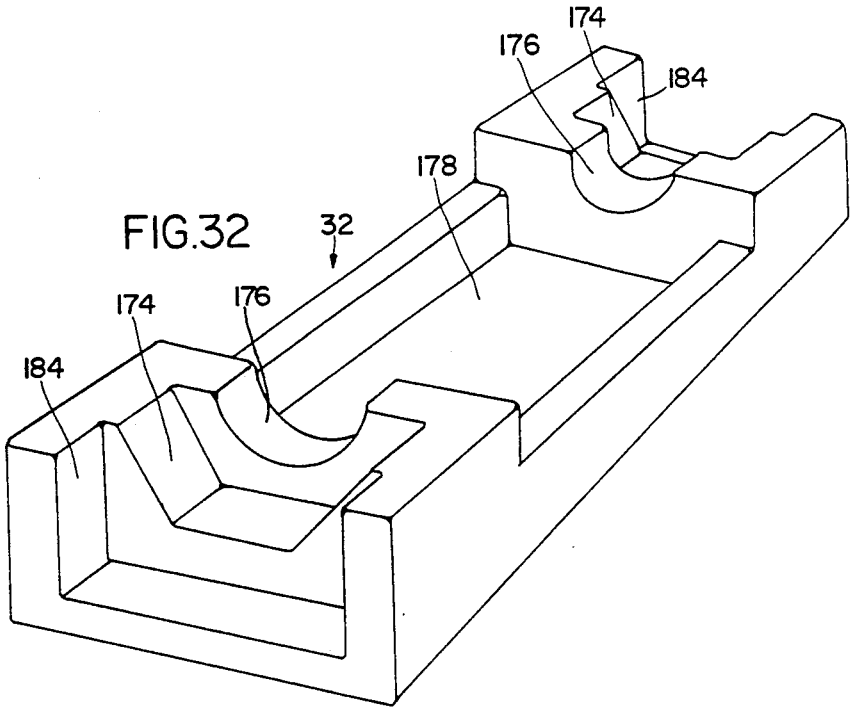
FIG. 32 is an enlarged perspective view of a top or a bottom piece (component) of the housing frame seen in FIG. 30. It will be noted that the twistor-pair of FIG. 22 with its hexagonal end mounts will neatly fit and nest into the housing components of FIGS. 32 and 31.

FIGS. 30 through 32 show how a monolithic torque unit, such as shown in FIG. 22, can advantageously be mounted in a four-piece housing frame 170 (FIG. 30) comprising four molded hard parts including two identical end pieces 38 and two identical side pieces 32. These two sides 32 and ends 38 can be machined from aluminum or machinable plastic, such as Delrin, or can be injection molded from relatively hard plastic.

Side piece 32 is shown in FIG. 32, and it will be seen that the two hexagonal mounting ends 21 of the dual twistor 90 shown in FIG. 22 will engage in respective semi-hex socket recesses 174 located at opposite ends of this side piece 32. Semi-cylindrical recesses 176 receive the respective tubular bodies of the two twistors. The central portion of each side piece 32 has a channel shape indicated at 178 for providing clearance for the drive gears 46 seen in FIG. 30. Fluid feed passages 43 (FIG. 31) are provided in the end pieces. If only one pair of such passages 43 is to be used, the unused passages in the other end piece are plugged.

An end piece 38, as shown in FIG. 31, includes a semi-hex socket recess 178 at each end adjacent to a semi-cylindrical recess 180, and has a central bearing opening 54 for journalling the shaft 41. There are rectangular end tabs 182 which are received in rectangular sockets 184 (FIG. 32) located at each end of the side pieces 32, thereby capturing and clamping the resilient hexagonal end mounts 21 in air-tight sealed relationship between the semi-hex sockets 174 and 178 for providing an air-tight connection to the adjacent passage 43.

In a preferred embodiment of my invention, the sides of the housing frame 170 in FIG. 30 are left open and the precise width of the frame 170 relative to the drive gears 46 is so chosen so that several such frames 170 can be aligned and rigidly attached side-by-side with their respective drive gears mating and engaged.

This efficient form of my invention requires only a single driven gear 48 on a single output shaft 41 regardless of the number of frames 170 so attaches side-by-side.

When three such units have been so attached, a total of 12 twistors have been fitted into a compact near-cubical package.

ADVANTAGE OF OPEN-LOOP CONTROL RESPONSE STIFFNESS IN MINIMIZING DISTURBING EFFECTS OF EXTERNAL TORQUE LOADING

In the open loop control provided by the pressures P1 and P2 supplied by a control system 47 (FIGS. 3A, 5 and 6), these pressures P1 and P2 are in accord with the following relationship:

$$P1 = Po \pm \Delta P \quad (1)$$

$$P2 = Po \mp \Delta P \quad (2)$$

This relationship between P1 and P2 was set forth earlier in connection with a description of the control system 47. This open-loop control relationship means that the amount of angular displacement of an output shaft or joint produced by a twistor pack 30, 30', 30A, 30B, 30C, 30D or 30E in the absence of any externally applied opposing torque depends solely upon the difference between the pressures P1 and P2. For example, P1 might be 3 pounds per square inch (psi) and P2 might be at 7 psi, with Po being 5 psi. This difference of 4 psi between 3 psi and 7 psi will produce a predetermined angular displacement in the absence of any externally applied opposing torque. However, an externally applied opposing torque will have the effect of reducing the angular displacement from the desired amount of displacement which would otherwise be provided by the difference of 4 psi produced by P1 at 3 psi and P2 at 7 psi.

In order to stiffen the open-loop control response of such twistor packs so as to minimize the motion-disturbing effect of an externally applied opposing torque load, the reference (average) pressure level Po is increased. Thus, setting Po at 55 psi and then providing P1 at 53 psi and P2 at 57 psi will produce the same angular displacement in the absence of opposition as P1 at 3 psi and P2 at 7 psi. However, the higher reference pressure level Po at 55 psi as compared with 5 psi provides a control response which is much stiffer (about ten or eleven times stiffer) in resisting the disturbing effects of opposing torque loadings. Therefore, it is desirable in practical open-loop controlled torque drives, where opposing external torque loads will occur, to be able to employ a considerable reference pressure level Po. Consequently, the twistors 10 need to be able to resist ballooning, i.e., to resist outward bulging of the wall 12 by pressurized fluid within the internal chamber 11. Webs 22 which are joined together by an on-axis junction 24 greatly strengthen the tubular wall 12 of the twistor body 18 for providing increased resistance against ballooning. The twistor configurations 10D (FIG. 10B) and 10E (FIG. 11B) are stronger for resisting ballooning than the other configurations shown. Therefore, it is my preference to use twistor body configurations similar to 10D or 10E where increased average pressure levels Po will be used for providing enhanced open-loop control response stiffness as desired for minimizing the displacement disturbances caused by significant external torque loadings.

It is to be noted that twisting the tubular wall 12 and its internal reinforcing webs 22, 22A or 22B or 22, 76 of a twistor from an untwisted condition into a helically twisted condition around the twist axis 15 reduces the volume of the internal chamber 11 inside of the tubular wall, thereby expelling fluid from the internal chamber 11 thereby deflating the twistor. When it is desired to produce fluid-driven torque from this helically twisted twistor, then pressurized fluid is fed into the internal chamber 11, thereby inflating the twistor. The portion of the internal volume which remains filled with fluid when the twistor is twisted to a desired limit is called "dead space", because this dead space must be inflated with pressurized fluid during the production of torque and does not contribute to the torque output. Thus, the amount of pressurized fluid needed to inflate this dead space is wasted. Consequently, it is desirable to reduce the dead space as much as possible. Those webs 22 which are imperforate and which are joined together at an on-axis junction 24 and which divide the internal chamber 11 into multiple compartments 20 isolated one from another are highly effective in reducing the undesired dead space in the internal chamber 11 in addition to providing increased resistance against ballooning of the tubular wall 12. Moreover, to provide increased resistance against such ballooning, it is desirable that the webs 22 be even in number, for example four, six, eight, ten or twelve of them uniformly spaced around the twist axis 15 so that these webs form pairs joined at the twist axis and oriented diametrically opposite each other (as will be most readily understood by looking at FIG. 11B) for providing wall-to-wall connections extending diametrically through the twist axis for resisting outward bulging of the wall 12.

ANALYSIS OF RADIAL BOW FORCE

Figure 33:
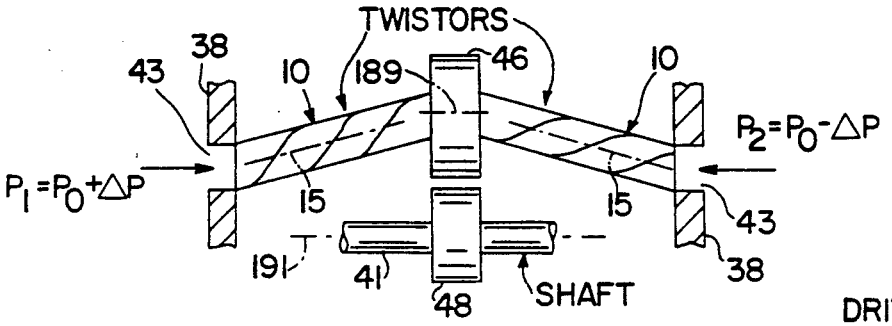
FIG. 33 sets forth analytical force diagrams and equations for explaining the advantageous action of the bowed (bow-legged) twistor-pair mounting arrangement shown in FIGS. 19, 14 and 16, respectively.
Figure 33:
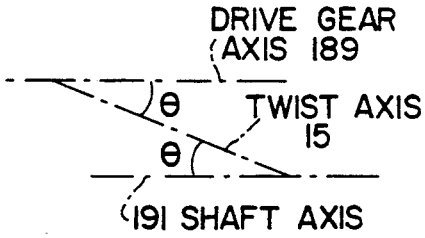
Figure 33:
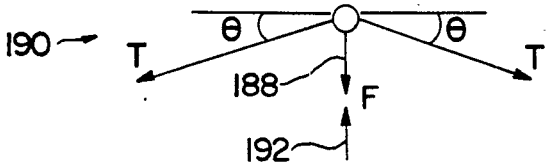
Figure 33:
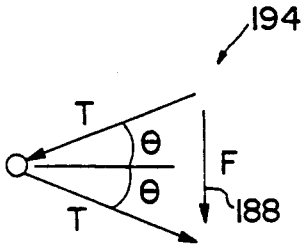

FIG. 33 provides an analysis regarding the bowed mounting arrangement, which is most clearly illustrated in FIG. 19 for providing a "RADIAL BOW FORCE". The radial bow force "F" is shown by an arrow 188 in a vector force diagram 190 having the legend "Force Diagram". The opposed gear-engagement force F is shown by an arrow 192. The vectors "T" at an angle "$\theta$" represent the tension force in the twistors 10. This angle $\theta$ is the angle between the twist axis 15 of each twistor 10 and the rotational axis 189 of the twistor-drive gear 46.

In order to have an "Equilibrium Balance", another vector force diagram 194 analyzes the magnitude of the radial bow force F (vector 188, in diagram 194) in terms of the tension force "T" and the bow angle "$\theta$". This vector analysis 194 results in an equation 196 for expressing the magnitude of the radial bow force F (indicated by vector 188) in terms of "T" and "$\theta$".

Equation 198 expresses the dynamic fact that the twistor tension force "T" is a function of the predetermined average (reference) fluid pressure Po by which these twistors 10 are being inflated. The symbol "K" represents a constant multiplied times the fluid pressure Po. The tension To represents the initial pretension.

Substituting "T" from the equation 198 into the equation 196 yields the conclusion equation 200 for the radial bow force:

$$F=[2K \sin \theta_o]P_o+F_o \quad (200)$$

where $$F_o=[2 \sin \theta_o]T_o$$

The above equation 200 shows that for a given (predetermined) bow angle $\theta$ the radial bow force F increases with to the average inflation pressure Po.

Also being analyzed is the "TWISTOR Active Stiffness Torque Level". This "Torque Level Mo" is equal to a constant "C" times the average inflation pressure Po as expressed by the equation 202. This torque level "Mo" is being analyzed, because the level of torque being delivered by the drive gear 46 to the driven gear 48 produces a reaction cam effect which is tending to cam (radially displace) the gear 46 away from the driven gear 48. (The driven gear 48 cannot significantly be displaced in a radial direction, since it is mounted on a stiff shaft 41; whereas, the drive gear 46 is flexurally mounted.)

Equation 202 shows that the Torque Level "Mo" is also directly proportional to the average inflation pressure Po. Therefore, as expressed by the final equation 204 the radial bow force F is advantageously increased with the gear-disengagement effect of the Torque Level Mo:

$$F=F_o+k\,M_o \quad (204)$$

In other words, the more that the reference pressure level Po is increased in order to provide an increased stiffness torque level Mo for resisting the displacement disturbance effects of externally applied torque loadings, the more that the radial bow force F increases for keeping the drive gear 46 engaged with the driven gear 48. Moreover, the increase in the radial bow force F is generally proportional to the increase in the stiffness torque level Mo for continuing in a matched relationship to resist the increasing tendency of the drive gear 46 to try to cam itself away from engagement with the driven gear 48 as pressure levels and torques are increased.

Since other changes and modifications varied to fit particular operating requirements and environments will be recognized by those skilled in the art, the invention is not considered limited to the examples chosen for purposes of illustration, and includes all changes and modifications which do not constitute a departure from the true spirit and scope of this invention as claimed in the following claims and equivalents thereto.

I claim:

1. A twistor comprising:

an elongated all-elastomer tubular wall defining a chamber, said elongated tubular wall having first and second ends, said elongated tubular wall having a central twist axis extending longitudinally therethrough and through said first and second ends, at least one of said ends having an axial opening communicating with said chamber, said tubular wall having a plurality of longitudinally extending all-elastomer internal reinforcing webs projecting inwardly from the tubular wall into the chamber, said all-elastomer internal reinforcing webs being integral with the tubular wall, first and second mounting means at said first and second ends, respectively, said first and second mounting means being in connected with said tubular wall, said first mounting means being turnable around said twist axis relative to said second mounting means for twisting said all-elastomer tubular wall and said all-elastomer internal reinforcing webs from a less-twisted condition into a generally helical condition, and said wall and webs twisted into said generally helical condition being drivable into said less-twisted condition by feeding pressurized fluid into said chamber for producing torque between said first and second mounting means.

2. A twistor as claimed in claim 1, in which:

said all-elastomer internal reinforcing webs are integral with the all-elastomer tubular wall.

3. A twistor as claimed in claim 2, in which:

said all-elastomer internal reinforcing webs resist ballooning of the tubular wall by pressurized fluid within said chamber.

4. A twistor as claimed in claim 3, in which:

said all-elastomer internal reinforcing webs extend inwardly from the tubular wall and are joined together for providing additional resistance to ballooning of the tubular wall.

5. A twistor as claimed in claim 4, in which:

said all-elastomer reinforcing webs have all-elastomer fillets integrally formed with the webs and tubular wall.

6. A twistor as claimed in claim 4, in which:

said all-elastomer internal reinforcing webs have openings therein.

7. A twistor as claimed in claim 4, in which:

said all-elastomer internal reinforcing webs are imperforate and divide said chamber into a plurality of compartments extending longitudinally within the tubular wall, and said longitudinally extending compartments are isolated one from another by said imperforate reinforcing webs.

8. A twistor as claimed in claim 4, in which: said all-elastomer internal reinforcing webs reduce the "dead space" in said chamber.

9. A twistor as claimed in claim 7, in which:

said all-elastomer internal reinforcing webs reduce the dead space in said chamber.

10. A twistor as claimed in claim 4, in which:

there are at least four of said all-elastomer internal reinforcing webs uniformly spaced around said twist axis.

11. A twistor as claimed in claim 10, in which:

said all-elastomer internal reinforcing webs have all-elastomer fillets integrally formed with the webs and also integrally formed with the tubular wall.

12. A twistor as claimed in claim 10, in which:

the number of said all-elastomer internal reinforcing webs is an even number, said webs are arranged in pairs joined at the twist axis and oriented diametrically opposite each other for providing wall-to-wall connections extending diametrically through the twist axis for resisting outward bulging of the wall.

13. A pressurized-fluid-actuatable twistor comprising:

first and second twistor ends spaced from each other along a twist axis extending longitudinally of said twistor though said ends, first and second mounting means at said first and second ends of the twistor, respectively, an elongated tubular wall of resilient elastomeric material extending between said first and second mounting means, said tubular wall being all-elastomer and encircling said twist axis, said tubular wall also encircling an elongated interior chamber with said twist axis extending longitudinally of said interior chamber, a plurality of interior webs of resilient elastomeric material joined to each other and joined to said tubular wall, each of said webs extending radially from said twist axis to said tubular wall and extending longitudinally within said interior chamber separating said interior chamber into a plurality of longitudinally extending compartments, each of said compartments being accessible from at least one end of said twistor, said first mounting means being turnable around said twist axis relative to said second mounting means for twisting said tubular wall and said webs into a generally helical condition from a less-twisted condition, whereby said first mounting means can be turned in a predetermined rotational sense around said twist axis relative to said second mounting means for twisting said tubular wall and said webs into said generally helical condition, and fluid passage means coupled to one of said ends of said twistor and communicating with said compartments for enabling pressurized fluid to be fed into said compartments for driving said tubular wall and said partitions toward said less-twisted condition, thereby providing torque between said first and second mounting means for rotationally driving said first mounting means around said twist axis relative to said second mounting means in a rotational sense around said twist axis opposite to said predetermined rotational sense.

14. A pressurized-fluid-actuatable twistor as claimed in claim 13, in which:

said elongated tubular wall of resilient elastomeric material and said interior webs of resilient elastomeric material are formed as an integral unit capable of being twisted about said twist axis into a generally helical condition.

15. A pressurized-fluid-actuatable twistor as claimed in claim 14, in which:

said integral unit is formed by extrusion.

16. A pressurized-fluid-actuatable twistor as claimed in claim 13, in which:

said first and second mounting means are first and second rims on said tubular wall, and said first and second rims each encircle the twist axis at the respective first and second ends of the twistor.

17. A pressurized-fluid-actuable twistor as claimed in claim 14, in which:

said tubular wall includes a hub positioned mid-way between said twistor ends, said hub is integral with said tubular wall, and said tubular wall extending from opposite sides of said hub has a circular cylindrical shape in an initial unpressurized, untwisted condition.

18. A pressurized-fluid-actuatable twistor as claimed in claim 14, in which:

said interior webs are all formed integrally joined at a common juncture extending concentric with the twist axis, and said webs extend radially relative to said twist axis as seen looking in a direction along said twist axis.

19. A pressurized-fluid-actuatable twistor as claimed in claim 18, in which:

said webs are at least four in number and said webs are all-elastomer and are uniformly spaced around said twist axis.

20. A pressurized-fluid-actuatable twistor as claimed in claim 19, in which:

the number of said internal webs is an even number, said webs are arranged in diametrically opposed pairs for providing wall-to-wall connections extending diametrically through the twist axis for resisting outward bulging of the all-elastomer wall upon inflation of said chamber with pressurized fluid.

21. A fluid-pressure-actuated twistor as claimed in claim 14, in which:

said second mounting means is an end fitting having a port extending therethrough in an axial direction and communicating with said chamber, said end fitting has an air-tight connection to said tubular wall, and said end fitting has an axially projecting end mount including a keyed configuration for being received into a mounting socket in keyed engagement with such socket for preventing rotation of said end fitting relative to said socket.

22. A fluid-pressure-actuated twistor as claimed in claim 21, in which:

said first mounting means is another end fitting having an axially projecting shaft with a toothed gear concentric with said shaft, and said shaft and toothed gear are concentric with said twist axis.

23. A fluid-pressure-actuated twistor as claimed in claim 14, wherein:

at least one of said first and second mounting means comprises an end fitting having an axis aligned with said twist axis, said end fitting has a plurality of axially extending dentations with a plurality of axially extending slots in alternate relationship with respect to said dentations, said dentations extending into said chamber with said dentations snugly in contact with interior surface regions of said tubular wall, portions of said webs snugly fitting into said slots, and attachment means securing said tubular wall to said dentations in air-tight relationship.

24. A pressurized-fluid-actuable torque driver comprising:

a first twistor including:

an elongated all-elastomer tubular wall defining a first chamber, said elongated tubular wall having first and second ends, said elongated tubular wall having central twist axis extending longitudinally through said first chamber and through said first and second ends, passage means communicating with said first chamber for enabling pressurized fluid to enter and exit said first chamber, said tubular wall having a plurality of longitudinally extending all-elastomer internal reinforcing means projecting inwardly from the tubular wall into the chamber, said all-elastomer internal reinforcing means being integral with the tubular wall, and first mounting means at said first end of said tubular wall, a drive gear having an axis concentric with said twist axis, said second end of said tubular wall being connected to said gear, a second twistor on the opposite side of said gear from said first twistor, said second twistor including:

a second elongated all-elastomer tubular wall defining a second chamber, said second elongated tubular wall having third and fourth ends, said second elongated tubular wall having a central twist axis extending longitudinally through said second chamber and through said third and fourth ends, said second tubular wall having a plurality of longitudinally extending all-elastomer internal reinforcing means projecting inwardly from the second tubular wall into the second chamber, said all-elastomer internal reinforcing means being integral with the tubular wall, and second mounting means at said third end, said second twistor having its twist axis concentric with the axis of said drive gear, said fourth end being connected to said drive gear on the opposite side from said second end and in concentric relationship with said second end, means defining an opening communicating with said second chamber for enabling pressurized fluid to enter and exit said second chamber, and said first and second twistors being twistable about their respective twist axes for permitting said gear to be turned about its axis relative to said first and second mounting means.

25. A pressurized-fluid-actuatable torque driver as claimed in claim 24, wherein:

said means defining said opening communicating with said second chamber is a bore in said second mounting means.

26. A pressurized-fluid-actuatable torque driver as claimed in claim 24, wherein:

said means defining said opening communicating with said second chamber is a port extending axially relative to said drive gear and providing communication between said first and second chambers for enabling fluid to enter and exit said second chamber via said port and said first chamber.

27. A pressurized-fluid-actuatable torque driver as claimed in claim 24, further comprising:

a housing, a shaft rotatably journalled in said housing and extending generally parallel with said axis of said drive gear, a driven gear engaging said drive gear, said first and second mounting means being mounted to said housing with the twist axis of said first twistor and the twist axis of said second twistor having a bowed relationship relative to said driven gear, and said driven gear being on the concave side of said bowed relationship for providing a radial bow force holding said drive gear in engagement with said driven gear.

28. A pressurized-fluid-actuatable torque driver as claimed in claim 24, wherein:

said first mounting means comprises a third twistor having its twist axis aligned with the twist axis of said first twistor, said third twistor being similar to said first twistor, the tubular wall of said third twistor communicating with the tubular wall of said second twistor in air-tight relation, and wherein:

said second mounting means comprises a fourth twistor having its twist axis aligned with the twist axis of said second twistor, said fourth twistor being similar to said second twistor, and the tubular wall of said fourth twistor communicating with the tubular wall of said second twistor in air-tight relation, whereby said first and third twistors comprise a twistor string on one axial side of said drive gear and said second and fourth twistors comprise another twistor string on the other axial side of said drive gear.

29. A twistor string comprising:

a plurality of twistors as claimed in claim 13 arranged in end-to-end relationship and being connected together with their respective twist axes in alignment and with their respective tubular walls coupled together in air-tight relationship for enabling the chambers within said plurality of twistors to be inflated and deflated in an axial direction through a twistor at one end of said twistor string.

30. A pressurized-fluid-actuatable torque driver as claimed in claim 27, further comprising:

third and fourth twistors being on opposite sides of a second drive gear and being connected to said second drive gear, said second drive gear engaging said driven gear diametrically opposite to the first drive gear, and said third and fourth twistors being mounted in said housing with their twist axes being in bowed relationship to said driven gear with said driven gear being on the concave side of said latter bowed relationship for providing a radial bow force holding said second drive gear in engagement with said driven gear.

31. A twistor drive assembly comprising:

a housing having first and second spaced ends, said housing having an interior between said ends, a shaft having an axis and being rotatably mounted in said housing for rotation about its axis, said shaft axis being oriented in a direction from end-to-end in said housing, a driven gear mounted on said shaft, a first drive gear engaging said driven gear, first and second twistors having a first and a second twist axis, respectively, said first and second twistors being on opposite sides of said first drive gear and being coupled to said first drive gear for rotating said first drive gear, said first and second twistors being mounted to said first and second ends, respectively, a second drive gear engaging said driven gear on the opposite side of said shaft axis from said first drive gear, third and fourth twistors having a third and a fourth twist axis, respectively, said third and fourth twistors being on opposite sides of said second drive gear and being coupled to said second drive gear for rotating said second drive gear, said third and fourth twistors being mounted to said first and second ends, respectively, and said first, second, third and fourth twistors having openings for enabling pressurized fluid to be fed into and to exit from said first, second, third and fourth twistors.

32. A twistor drive assembly as recited in claim 31, further comprising:

said first, second, third and fourth twistor each having a plurality of compartments therein, and the plurality of compartments in each of said twistors extending in an axial direction in the respective twistor.

33. A twistor drive assembly as claimed in claim 31, in which:

said first and second twist axes are closer to said shaft axis near said first and second ends of the housing than near said drive gear for providing a first radial bow force urging said first drive gear toward said driven gear, and said third and fourth twist axes are closer to said shaft axis near said first and second ends of the housing than near said driven gear for providing a second radial bow force for urging said second drive gear toward said driven gear.

34. A twistor drive assembly as recited in claim 31, in which:

said openings in said first and second twistors are located remote from said first drive gear, said openings in said third and fourth twistors are located remote from said second drive gear, and said first, second, third and fourth twistors are generally helically twisted in the same sense about their respective first, second, third and fourth twist axis.

35. A twistor drive assembly as claimed in claim 31, further comprising:

said first drive gear having an opening therethrough, said first twistor having openings at both axial ends thereof for enabling fluid to be fed into and to exist from both axial ends thereof, the opening at said axial end of said first twistor which is coupled to said first drive gear communicating with said opening through said first drive gear, said opening of said second twistor being at the axial end of said second twistor communicating with said opening through said first drive gear, said second drive gear having an opening therethrough, said third twistor having openings at both axial ends thereof for enabling fluid to be fed into and to exit from both axial ends thereof, the opening at said axial end of said third twistor coupled to said second drive gear having an opening communicating with said opening through said third drive gear, said opening at said fourth twistor communicating with said opening through said second drive gear, said first and second twistor being twisted in opposite helical senses about said first and second twist axis for causing said first and second twistors to provide fluid-driven torque in aiding relationship to said first drive gear, said third and fourth twistors being twisted in opposite helical senses about said third and fourth twist axis for causing said third and fourth twistors to provide fluid-driven torque in aiding relationship to said second drive gear, and said third twistor being twisted about said third axis in opposite helical sense to the twist of said first twistor about said first axis and said fourth twistor being twisted about said fourth axis in opposite helical sense to the twist of said third twistor about said third axis for causing said third and fourth twistors to provide fluid-driven torque to said second drive gear for rotating said driven gear in an opposite direction from the direction of rotation of said driven gear produced by the fluid-driven torque of said first and second twistors.

36. A twistor drive assembly as recited in claim 31, further comprising:

a third drive gear engaging said driven gear, fifth and sixth twistors having a fifth and a sixth twist axis, respectively, said fifth and sixth twistors being on opposite sides of said third drive gear and being coupled to said third drive gear for rotating said third drive gear, said fifth and sixth twistors being mounted respectively to said first and second ends of the housing, a fourth drive gear engaging said driven gear, seventh and eighth twistors having a seventh and eighth twist axis, respectively, said seventh and eighth twistors being on opposite sides of said fourth drive gear and being coupled to said fourth drive gear for rotating said fourth drive gear, said seventh and eighth twistors being mounted respectively to said first and second ends of the housing, and said firth, sixth, seventh and eighth twistors having openings for enabling pressurized fluid to be fed into and to exit from said first, second, third and fourth twistors.

37. A twistor drive assembly as recited in claim 33, further comprising:

a third drive gear engaging said driven gear,
fifth and sixth twistors having a fifth and a sixth twist axis, respectively,
said fifth and sixth twistors being on opposite sides of said third drive gear and being coupled to said third drive gear for rotating said third drive gear,
said fifth and sixth twistors being mounted respectively to said first and second ends of the housing,
a fourth drive gear engaging said driven gear,
seventh and eighth twistors having a seventh and an eighth twist axis, respectively,
said seventh and eighth twistors being on opposite sides of said fourth drive gear and being coupled to said fourth drive gear for rotating said fourth drive gear,
said seventh and eighth twistors being mounted respectively to said first and second ends of the housing,
said fifth, sixth, seventh and eighth twistors having openings for enabling pressurized fluid to be fed into and to exit from said first, second, third and fourth twistors,
said fifth and sixth twist axes being closer to said shaft axis near said first and second ends of the housing than near said driven gear for providing a third radial bow force urging said third drive gear toward said driven gear, and
said seventh and eighth twist axes being closer to said shaft axis near said first and second ends of the housing than near said driven gear for providing fourth radial bow force urging said fourth drive gear toward said driven gear.

38. A twistor drive assembly comprising:
a housing having first and second spaced ends,
a shaft having an axis and being rotatably mounted in said housing for rotation about its axis,
said shaft axis extending in a direction from end-to-end of said housing,
a driven gear on said shaft,
a plurality of twistor-pairs
each twistor-pair comprising first and second twistors having respective first and second twist axes and being on opposite sides of a drive gear and being coupled to the drive gear which they share,
the first twistors of said plurality of twistor-pairs being mounted to said first end of the housing,
the second twistors of said plurality of twistor-pairs being mounted to said second end of the housing,
all of the twistors in said twistor-pairs having openings for permitting fluid to enter and exit an interior of each twistor,
the first and second twist axes of each twistor-pair laying in a plane in which lies said shaft axis, and
the drive gears of all of said twistor pairs engaging said driven gear.

39. A twistor-drive assembly as recited in claim 38, in which:
a second plurality of twistor pairs,
each twistor-pair of said second plurality comprising first and second twistors having respective first and second twist axes on opposite sides of a drive gear and being coupled to the drive gear which they share,
the first twistors of said second plurality of twistor-pairs being mounted to said first end of the housing,
the second twistors of said second plurality of twistor-pairs being mounted to said second end of the housing,
all of the twistors in said twistor-pairs of said second plurality having openings for permitting fluid to enter and exit an interior of each twistor, and
the respective drive gears of the twistor-pairs of said second plurality being in driving relationship with a respective drive gear of the twistor-pairs of said first plurality.

40. A twistor drive assembly as recited in claim 38, further comprising:
a plurality of third twistors each having a third twist axis,
respective third twistors having their respective third twist axes aligned with respective first twist axes and being mounted between respective first twistors and said first end of the housing forming a plurality of first strings of twistors each including a first and a third twistor,
said first strings of twistors each extending between said drive gear and said first end of the housing,
a plurality of fourth twistors each having a fourth twist axis,
respective fourth twistors having their respective fourth twist axes aligned with respective third twist axes and being mounted between said third twistors and said second end of the housing forming a plurality of second strings of twistors each including a second and a fourth twistor,
said second strings of twistors each extending between said drive gear and said second end of the housing, and
all of said third and fourth twistors having openings at both axial ends of said third and fourth twistors for permitting fluid to enter and exit an interior of each of said third and fourth twistors and for permitting fluid to enter and exit the respective first and second twistors via said third and fourth twistors.

41. A twistor drive assembly as claimed in claim 38, in which:
said housing includes first and second spaced sides,
the first side being a top side and extending between a top portion of said first and second ends,
the second side being a bottom side and extending between a bottom portion of said first and second ends,
said top portions of the respective first and second ends each having a semi-socket therein,
said bottom portions of the respective first and second ends each having a semi-socket therein,
said top side having semi-sockets contiguous with the respective semi-sockets of the top portions of said first and second ends,
said bottom side having semi-sockets contiguous with the respective semi-sockets of the bottom portions of said first and second ends,
each of said twistor-pairs having a first mount located at the axial end of said first twistor remote from said drive gear,
each of said twistor-pairs having a second mount located at the axial end of said second twistor remote from said drive gear,
the first twistor of said plurality of twistor-pairs being mounted to said first end of the housing by capturing the respective first mounts in keyed relationship in respective sockets formed by the contiguous semi-sockets between the top side and the top portions of said ends, and the second twistors of said plurality of twistor-pairs being mounted to said second end of the housing by capturing the respective second mounts in keyed relationship in respective sockets formed by the contiguous semi-sockets between the bottom side and the bottom portions of said ends.

42. A twistor drive assembly as recited in claim 41, in which:

said ends of the housing are identical to each other, said sides of the housing are identical to each other, said two ends and said two sides are molded from relatively hard plastic, and said mounts of said twistor pairs are formed of resilient elastomeric material.

43. A twistor drive assembly as recited in claim 42, in which:

said mounts having a regular polygonal configuration as seen looking in an axial direction.

44. A twistor drive assembly as recited in claim 43, in which:

said mounts have a hexagonal configuration, and said semi-sockets each has three-faces in a semi-hexagonal configuration.

45. A twistor drive assembly as claimed in claim 43, in which:

each of said twistor-pairs is molded from elastomeric material, and the drive gear of each twistor-pair comprises a hub bridging and coupled to the respective first and second twistors with a ring gear formed from relatively hard material encircling said hub and being mounted to said hub.

46. A fluid-powered joint comprising:

first and second struts hinged together at a swingable connection having a pivot axis, a twistor string comprising a plurality of twistors connected in end-to-end relationship, said twistor string extending longitudinally along said first strut, one end of said twistor string being anchored to said first strut, said twistor string being connected to a drive gear for turning said drive gear, a driven gear connected to said second strut and being concentric with said pivot axis, said drive gear having a driving connection to said driven gear, and said twistor string having an opening at said one end for fluid to enter and exit said twistor string.

47. A fluid-powered joint as claimed in claim 46, in which:

said drive and driven gears are bevel gears directly engaging each other for providing a single-acting joint, and spring means for swinging said second strut in the opposite direction from the direction provided by said twistor string.

48. A fluid-powered joint as claimed in claim 46, in which:

at least said first strut is a tube having a hollow interior, and said twistor string is housed within said hollow interior of said first strut.

49. A fluid-powered joint as recited in claim 46, further comprising:

a second twistor string extending longitudinally along said first strut;

the first and second twistor strings being on opposite sides of said drive gear, said second twistor string being connected to said drive gear for rotating said drive gear in the opposite direction from the first twistor string, also connected to said drive gear, a transfer sheet extending parallel to said first strut, a spur gear on said transfer shaft engaging said drive gear, said driven gear being a driven worm gear, and said transfer gear having a worm gear engaging said driven worm gear for providing double-acting fluid-powered drive for said joint.

50. A twistor-drive assembly as recited in claim 31, further comprising:

an output shaft, and a sprag connection said output shaft to said shaft rotatably mounted in said housing, whereby said output shaft provides rotation in one direction.

51. A twistor-drive assembly as recited in claim 46, further comprising:

an output shaft, and a sprag connecting said output shaft to said shaft rotatably mounted in said housing, whereby said output shaft provides rotation in one direction.

52. A fluid-powered joint as recited in claim 47 in which:

the said spring means is a leaf spring whose ends are attached to the said first and second shafts, respectively.

53. A fluid-powered joint as recited in claim 47 in which:

the said spring means is a joint-concentric torsional coil spring whose tangs engage members rigidly connected to the said first and second struts, respectively.

54. A fluid-powered joint as recited in claim 51 in which:

said sprag is controllably reversible so as to permit joint-rotation in either direction, and where said sprag has a third intermediate controllable locking position so to prevent joint-rotative in either direction.

55. A twistor drive assembly as recited in claim 50 in which:

said sprag is controllably reversible so to permit shaft rotation in either direction, and said sprag has a third intermediate and controllable locking position so to prevent shaft rotation in either direction.

56. A twistor drive assembly as recited in claim 50 further comprising one or more angular limit switches or similar devices attached to the output shaft, said limit switches being set so as to activate one 4-way valve or two 3-way valves, and whereby said limit switch(es) and said valve(s) are caused to supply pressurized fluid to the twistors where they reach their extreme twisted configuration and, conversely are caused to vent the fluid from the twistors when they reach their extreme untwisted configuration, the above arrangement of limit switches and valves producing a sustained nutating angular oscillation of the output shaft.

57. A twistor drive assembly as recited in claim 38 in which:

the housing remains open at the two opposite sides, the drive gears protrude an appropriate distance outside this opening, so that a multiple number of such assemblies may be aligned and attached rigidly side-by-side and whereby the corresponding drive gears mate and engage, with their resultant torques summed on a common shaft.

58. A twistor drive assembly comprising:

at least one twistor-pair, said twistor-pair including first and second fluid-actuatable twistors having respective first and second twist axes, a rotational drive member having a drive axis, said rotational drive member having first and second sides on opposite sides of said drive member, said first and second twistors being located on opposite sides of said rotational drive member, said first twistor including a first tubular elastic body coupled to said first side of said rotational drive member with said first twist axis being concentric with said drive axis, said first tubular elastic body having an interior divided into a plurality of longitudinally extending pressure chambers by a plurality of elastic partitions, said second twistor including a second tubular elastic body coupled to said second side of said rotational drive member with said second twist axis being concentric with said drive axis, said second tubular elastic body having an interior divided into a plurality of longitudinally extending pressure chambers by a plurality of elastic partitions, and means for supplying pressurized fluid to said pressure chambers in said first and second tubular elastic bodies.

59. A twistor drive assembly as claimed in claim 58, in which:

said first and second tubular elastic bodies and their respective elastic partitions are mounted under initial pretension.

60. A twistor drive assembly as claimed in claim 58, in which:

said pressurized fluid is supplied at a pressure P1 to said pressure chambers in said first tubular elastic body and is supplied at a pressure P2 to said pressure chambers in said second tubular elastic body, and said pressures P1 and P2 are in accord with the following relationship:

$$P1 = P_o \pm \Delta P$$

$$P2 = P_o \mp \Delta P$$

wherein $P_o$ is a predetermined and adjustable reference pressure level and $\Delta P$ is a controllable pressure increment relative to the reference pressure level.

61. A twistor drive assembly as claimed in claim 58, in which:

said first and second tubular elastic bodies and their elastic partitions are mounted in an initial pre-twisted condition.

62. A twistor drive assembly as claimed in claim 58, in which:

said first and second tubular elastic bodies and their respective elastic partitions are mounted under initial pretension, and said first and second tubular elastic bodies and their respective elastic partitions are also mounted in an initial pre-twisted condition.

63. A twistor string as claimed in claim 29, including:

a plurality of ring clamps encircling said twistor string, a respective ring clamp being positioned between successive twistors in said twistor string.

64. A twistor string as claimed in claim 63, in which:

said twistors have an outside diameter, and said ring clamps are uniformly spaced apart in the axial direction by an axial distance in the range of about 1.5 to about 3.0 times said outside diameter.

65. A twistor drive assembly as claimed in claim 31, in which:

said housing has open sides, said housing has a width relative to said first and second drive gears for enabling at least one other similar twistor-drive assembly housing to be mounted side-by-side with said housing with its respective drive gears engaging said first and second drive gears.

* * * * *